US010022766B2

(12) United States Patent
Fujii et al.

(10) Patent No.: US 10,022,766 B2
(45) Date of Patent: Jul. 17, 2018

(54) PRESS FORMING METHOD AND METHOD OF MANUFACTURING PRESS-FORMED PART

(71) Applicant: JFE STEEL CORPORATION, Tokyo (JP)

(72) Inventors: Yusuke Fujii, Fukuyama (JP); Toyohisa Shinmiya, Fukuyama (JP); Yasuhiro Kishigami, Chiba (JP); Eiji Iizuka, Fukuyama (JP); Yuji Yamasaki, Fukuyama (JP)

(73) Assignee: JFE STEEL CORPORATION, Tokyo (JP)

( * ) Notice: Subject to any disclaimer, the term of this patent is extended or adjusted under 35 U.S.C. 154(b) by 138 days.

(21) Appl. No.: 14/906,240

(22) PCT Filed: Jul. 18, 2014

(86) PCT No.: PCT/JP2014/003823

§ 371 (c)(1),
(2) Date: Jan. 19, 2016

(87) PCT Pub. No.: WO2015/008495

PCT Pub. Date: Jan. 22, 2015

(65) Prior Publication Data

US 2016/0158821 A1 Jun. 9, 2016

(30) Foreign Application Priority Data

Jul. 19, 2013 (JP) ..... 2013-150701
Jun. 3, 2014 (JP) ..... 2014-115164

(51) Int. Cl.
*B21D 22/02* (2006.01)
*B21D 22/20* (2006.01)
(Continued)

(52) U.S. Cl.
CPC ..... *B21D 22/02* (2013.01); *B21D 5/06* (2013.01); *B21D 19/08* (2013.01); *B21D 22/20* (2013.01); *B21D 25/00* (2013.01); *B21D 53/88* (2013.01)

(58) Field of Classification Search
CPC ..... B21D 22/02; B21D 22/20; B21D 22/22; B21D 24/04; B21D 5/06; B21D 19/08; B21D 25/00
See application file for complete search history.

(56) References Cited

U.S. PATENT DOCUMENTS 7,654,124 B2 * 2/2010 Knaup ..... B21D 22/22 72/296
2008/0053184 A1 3/2008 Knaup
(Continued)

FOREIGN PATENT DOCUMENTS

CN 101014428 A 8/2007
CN 101018627 A 8/2007
(Continued)

OTHER PUBLICATIONS

May 19, 2015 Notice of Allowance issued in Japanese Patent Application No. 2014-559970.
(Continued)

*Primary Examiner* — Debra Sullivan
(74) *Attorney, Agent, or Firm* — Oliff PLC

(57) ABSTRACT

There is provided a method of manufacturing a curved channel part having a curved portion in a vertical wall portion by press forming, the method restricting stretch flange deformation, which occurs in the vertical wall portion and a flange portion. The method includes a shear deformation step as a step of forming the vertical wall portion. In the shear deformation step, a boundary-side portion of a base section of a blank with respect to a deformation section, and an outer portion of the deformation section are individually
(Continued)

restrained, a portion to be a vertical wall portion of the deformation section is shear-deformed in a sheet face, and a material is caused to flow from a portion separated from a curved portion toward the curved portion in an outer edge portion of the portion to be the vertical wall portion.

20 Claims, 11 Drawing Sheets

(51) Int. Cl.

| | |
|---|---|
| ***B21D 5/06*** | (2006.01) |
| ***B21D 19/08*** | (2006.01) |
| ***B21D 25/00*** | (2006.01) |
| *B21D 53/88* | (2006.01) |

(56) References Cited

U.S. PATENT DOCUMENTS

| | | | |
|---|---|---|---|
| 2009/0049886 | A1 | 2/2009 | Okuzumi et al. |
| 2012/0297853 | A1 | 11/2012 | Tanaka et al. |
| 2013/0239645 | A1 | 9/2013 | Tanaka et al. |

FOREIGN PATENT DOCUMENTS

| | | | |
|---|---|---|---|
| CN | 102791396 | A | 11/2012 |
| DE | 19853130 | A1 | 5/2000 |
| EP | 1787737 | A1 | 5/2007 |
| EP | 1790422 | A1 | 5/2007 |
| JP | 2001-314918 | A | 11/2001 |
| JP | 2002-001445 | A | 1/2002 |
| JP | 2008-055511 | A | 3/2008 |
| JP | 2009045653 | A | 3/2009 |
| JP | 2009-160655 | A | 7/2009 |
| JP | 2013-013907 | A | 1/2013 |
| KR | 20050094894 | A | 9/2005 |
| WO | 2012/070623 | A1 | 5/2012 |

OTHER PUBLICATIONS

Jun. 20, 2017 Office Action issued in Chinese Patent Application No. 201480040343.9.

Jun. 13, 2016 Extended European Search Report issued in European Application No. 14826390.8.

Oct. 21, 2014 Search Report issued in International Application No. PCT/JP2014/003823.

Oct. 9, 2016 Office Action issued in Chinese Patent Application No. 201480040343.9.

Sep. 12, 2017 Office Action issued in Korean Patent Application No. 10-2016-7000477.

* cited by examiner

PRESS FORMING METHOD AND METHOD OF MANUFACTURING PRESS-FORMED PART

TECHNICAL FIELD

This application relates to a technique of press forming for forming a material into a press-formed part having a curved vertical wall portion, such as a curved channel part. This technique is particularly preferable for press forming on a portion of a curved portion of a vertical wall portion that is deformed in a manner of stretch flange deformation by forming.

BACKGROUND

In recent years, to attain both crush safety of a vehicle and weight reduction of a vehicle body, a steel sheet with a higher strength is demanded. However, as the tensile strength of a steel sheet increases, the ductility significantly relating to press formability tends to decrease. Owing to this, a shape that can be formed even with a steel sheet having a low ductility is being studied for example, by simplifying the shape of a press-formed part. A press forming method suitable for a steel sheet having a high strength is being studied.

In case of press forming a steel sheet having a low ductility and a high strength, deep drawing or stamping (bending) is typically employed. For example, a channel part with a simple shape including a vertical wall portion and a top portion continuous to the vertical wall portion but not including a curved portion in the vertical wall portion is manufactured by stamping. Also, a flanged channel part is manufactured by deep drawing.

In stamping, a blank (a flat-sheet-shaped processing material) is arranged on a punch, and the blank is bent with a die, to obtain a product shape. To restrict generation of a wrinkle at a blank portion, which contacts an upper section of the punch, a blank may be pinched and held by the punch and a pad.

In deep drawing, first, a blank holder is arranged at a position corresponding to a flange portion, a blank is arranged on a punch and the blank holder, and a die is arranged above the blank. Then, by lowering the die, the blank is held by the die and the blank holder, and the blank is bent while a load of a proper tensile force is applied to the blank. At this time, the material (the blank) is largely drawn into an area between the punch and the die as the result that the material is held by the die and the blank holder forms a vertical wall portion. Hence, the vertical wall portion is easily formed even when the material has a low ductility.

As a method of adjusting a tensile force, there may be a method of changing a holding force (a cushion pressure) of holding the blank by the die and the blank holder, and a method of arranging a bead at the holding position. If the tensile force applied to the blank is too weak, the material excessively flows to the vertical wall portion, and a wrinkle (a material excess) is likely generated. In contrast, if the tensile force is excessive, the amount of the material flowing to the vertical wall portion is reduced. At forming the vertical wall portion the material is required to be stretched and a crack may be generated if the material has a low ductility.

A press-formed part for a vehicle includes a curved channel part having a curved portion in a vertical wall portion (for example, a lower arm part shown in FIG. 10), and a curved channel part having a flange portion (for example, a center pillar part shown in FIG. 3).

If a curved channel part having a curved portion in a vertical wall portion is manufactured by stamping, when a material is drawn into a vertical-wall-portion formation space of a die and the vertical wall portion is formed, the line length of the material is sufficient at the curved portion, and the material is stretched and deformed in a circumferential direction of the curved portion. This deformation is called "stretch flange deformation." The stretch flange deformation becomes larger as the material is drawn into the vertical-wall-portion formation space from a position more separated from the curved portion (for example, a portion 42*a* in FIG. 10 or a portion 22*a* in FIG. 3). Hence, if the ductility of the material is insufficient in a portion near an outer edge portion of the vertical wall portion, a crack may be generated.

Even when a curved channel part with a flange portion is manufactured by deep drawing, similarly, the flange portion is stretched in the circumferential direction of the above-described curved portion, and hence a crack caused by stretch flange deformation may be generated.

The crack caused by stretch flange deformation is a problem particularly for a material, such as a steel sheet with a high strength, the material which likely has an insufficient ductility. Also, even in a case of a material other than the steel sheet, if the material has a low ductility, a crack caused by stretch flange deformation may be generated. For example, there may be a case in which an aluminum alloy sheet is used for an outer panel of a vehicle for reducing the weight of a vehicle body of the vehicle. In this case, since aluminum alloy tends to have lower press formability than that of a steel sheet, if press forming with stretch flange deformation is executed, a crack may be generated in the outer panel.

To prevent a crack caused by this stretch flange deformation, Patent Literature 1 suggests a method of previously applying a material excess portion (for example, a protruding and depressed shape) at a position of a blank expected to have stretch flange deformation by press forming, and hence preventing the line length of a material from being insufficient in a curved portion during press forming. Also, Patent Literature 2 suggests a method of dispersing stretch flange deformation by an outer edge portion of a vertical wall portion, and hence preventing stretch flange deformation from being locally concentrated.

CITATION LIST

Patent Literature

PTL 1: Japanese Unexamined Patent Application Publication No. 2002-1445

PTL 2: Japanese Unexamined Patent Application Publication No. 2009-160655

SUMMARY

Technical Problem

The methods suggested in Patent Literatures 1 and 2 are each a method of preventing the line length of the material from being insufficient even when stretch flange deformation occurs, but are not each a method of preventing occurrence of the stretch flange deformation which may cause a crack to be generated in the outer edge portion of the vertical wall portion or the flange portion. Owing to this, these methods have limitation, and cannot prevent a crack caused by stretch flange deformation from being generated, if large stretch flange deformation occurs depending on the height of the vertical wall portion or the curved shape, or if the material has low press formability.

An object of disclosed embodiments is to provide a press forming method of manufacturing a press-formed part, such as a curved channel part, having a curved portion in a vertical wall portion by press forming, the method restricting stretch flange deformation, which occurs in the vertical wall portion and a flange portion.

Solution to Problem

To address the above-described problems, according to embodiments, there is provided a press forming method of press-forming a flat-sheet-shaped processing material (a blank) into a press-formed part, the processing material including a base section and a deformation section continuous to the base section and including a portion to be a vertical wall portion, the press-formed part having the vertical wall portion formed when the processing material is bent in at least a boundary portion between the base section and the vertical wall portion, the vertical wall portion having a curved portion being curved in a depressed shape toward the base section. As a step of forming the vertical wall portion, the press forming method includes a shear deformation step of individually restraining a boundary-side portion of the base section with respect to the deformation section and an outer portion of the deformation section, shear-deforming the portion to be the vertical wall portion of the deformation section in a sheet face, and causing a material to flow from a portion separated from the curved portion toward the curved portion in an outer edge portion of the portion to be the vertical wall portion.

For example, as shown in FIG. 1A, (1) the method is a method of manufacturing a curved channel part by press forming by using a blank 1, the blank 1 including a base section 11 that is not deformed and a deformation section 12 that is deformed by press forming, the blank 1 including a portion 12*a* to be a vertical wall portion in the deformation section 12, the curved channel part having a curved portion in the vertical wall portion. (2) As a step of forming the vertical wall portion, the method includes a shear deformation step of individually restraining a boundary-side portion 11*a* of the base section 11 with respect to the deformation section 12 and an outer portion 12*b* of the deformation section 12, shear-deforming the portion 12*a* to be the vertical wall portion of the deformation section 12 in a sheet face, and as shown in FIG. 1B, causing a material to flow (movement of the material in the blank) from a portion separated from the curved portion toward the curved portion in an outer edge portion of the portion 12*a* to be the vertical wall portion. The outer portion 12*b* is a portion to be a flange portion if a curved channel part with a flange portion is manufactured, and is a portion to be transiently a flange portion if a curved channel part without a flange portion is manufactured.

As shown in FIG. 2, shear deformation is deformation in which a rectangle ABCD is deformed into a parallelogram ABC1D1 when parallel forces in opposite directions (shear forces) are applied in an AB direction and a DC direction.

With the method of this aspect, as shown in FIG. 1B, in the shear deformation step, the material flows as indicated by arrow X (from the portion separated from the curved portion toward the curved portion) in the outer edge portion of the portion 12*a* to be the vertical wall portion. Accordingly, stretch flange deformation hardly occurs in the outer edge portion of the curved portion.

Also, in the shear deformation step, since the outer portion 12*b* and the boundary-side portion 11*a* are restrained, stretch flange deformation and generation of a wrinkle in these portions are restricted.

Also, in the shear deformation step, since the outer portion 12*b* and the boundary-side portion 11*a* are restrained, the material cannot be moved, and the portion 12*a* to be the vertical wall portion is shear-deformed in the sheet face. Accordingly, the shear deformation step can be stably executed even if the surface roughness and clearance of a die; the cushion force; the intensity, stretch, and thickness of a blank; etc., vary during volume production.

In the press forming method according to this aspect, in the step of forming the vertical wall portion, when viewed in a thickness direction of the flat-sheet-shaped processing material, from a state in which a second restraining section that restrains the outer portion of the deformation section is separated from a first restraining section that restrains the boundary-side portion, the second restraining section may be relatively moved in a direction in which a separation distance between the first restraining section and the second restraining section decreases as the boundary portion is bent.

In the press forming method of this aspect, the shear deformation step can be executed by a method of the following configuration (3) or (4).

(3) A method is moving the restrained outer portion so that the portion to be the vertical wall portion is rotated around a bending point of the curved portion on a boundary line between the base section and the deformation section. In FIG. 1A, a line L is the boundary line, and a point B is the bending point of the curved portion.

(4) Another method is linearly moving the restrained outer portion in a direction in which an angle with respect to the sheet face of the blank is in a range from 30° to 60°. The angle is preferably in a range from 40° to 50°, and is more preferably 45°.

With the method of the configuration (3), in the shear deformation step, the cross-sectional shape and dimension of the portion to be the vertical wall are hardly changed in a portion other than a portion which is changed to the bent portion (boundary portions of the vertical wall portion with respect to the top portion and the flange portion). Accordingly, a stretch or a wrinkle is hardly generated in the vertical wall portion.

With the method of the configuration (4), in the shear deformation step, the cross-sectional shape and dimension of the portion 12*a* to be the vertical wall portion are changed. However, by setting the angle in the range from 30° to 60°, a stretch which occurs in the vertical wall portion is not so large that the stretch causes a crack to be generated. A wrinkle generated in the vertical wall portion can be brought into a removable state in post-processing.

If the angle is smaller than 30°, when the vertical wall portion is formed only in the shear deformation step, the corrected degree of deformation of the portion to be the vertical wall portion (the state in which the material is excessive and bent) is insufficient, and a wrinkle generated in the vertical wall portion may not be removed by post-processing. If the angle exceeds 60°, the material of the portion to be the vertical wall portion is largely stretched (the direction of this stretch differs from the direction of the shear deformation), and a crack may be generated due to insufficiency in ductility of the material.

The press forming method of this aspect may be executed in combination with the shear deformation step, a deep drawing step of related art, and a stamping step of related art like the configurations (5) to (7).

(5) As the step of forming the vertical wall portion, the shear deformation step is executed and then a deep drawing step is executed. (6) As the step of forming the vertical wall portion, a deep drawing step is executed and then the shear deformation step is executed. (7) The curved channel part does not have a flange portion at an outer side of the vertical wall portion, and as the step of forming the vertical wall portion, the shear deformation step is executed and then a stamping step is executed.

In each of the configurations (5) and (6), by executing the shear deformation step as pre-processing or post-processing of the deep drawing step being a press forming method of related art, as compared with a case in which the vertical wall portion is formed only in the deep drawing step, stretch flange deformation of the curved channel part is reduced.

In the press forming method of this aspect, the outer portion 12*b* of the deformation section is present in a flange shape at the outside of the vertical wall portion. Accordingly, if a curved channel part without a flange portion is manufactured by the press forming method of this aspect, at the outside of the vertical wall portion, post-processing is required. The post-processing may be a method of removing the flange-shaped outer portion 12*b* by using laser cutting and a trim die.

As the post-processing, with the configuration (7), instead of removing the outer portion 12*b*, the stamping step being a press forming method of related art is executed. With the configuration (7), as compared with a case in which the vertical wall portion is formed only in the stamping step, stretch flange deformation of the curved channel part is reduced. Also, even in a method executing post-processing of removing the flange-shaped outer portion 12*b* after the shear deformation step is executed, as compared with the case in which the vertical wall portion is formed only in the stamping step, stretch flange deformation of the curved channel part is reduced.

The press forming method of this aspect may include the following configuration (8) or (9). (8) The press forming method includes a wrinkle stretching step of stretching a wrinkle, which is generated in the vertical wall portion, by pinching the vertical wall portion with a die after the shear deformation step.

At this time, if a press surface of the die, which contacts the vertical wall portion, has a depression and a protrusion to increase a line length of the vertical wall portion, a wrinkle in the vertical wall portion is further stretched.

(9) The shear deformation step is executed on a blank that is heated at a temperature in a range from 300° C. to 1000° C. The temperature is more preferably in a range from 400° C. to 900° C.

With the configuration (9), the material of the blank is softened in the shear deformation step. Accordingly, shear deformation likely occurs in the portion to be the vertical wall portion, and even if a wrinkle is generated in the portion to be the vertical wall portion, the wrinkle is likely stretched. The heating position of the blank may be the portion to be the vertical wall portion, or the blank may be entirely heated. Even if the blank is entirely heated, the material of the portion to be restrained is cooled by the die and is hardened. Accordingly, the entirely heated blank does not affect the restraint.

If the heating temperature is lower than 300° C., the material is insufficiently softened. Hence, there is no particular advantage of heating. If the heating temperature is higher than 1000° C., a thick scale is generated on the surface of the blank (the steel sheet). The method of heating the blank may be a typical heating method, such as heating in a heating furnace, high-frequency heating, or electrical heating.

It is to be noted that the material of the blank to be used in the press forming method of this aspect may be any of materials of blanks used in press forming methods of related art. For example, even in a case of a blank with difficulty in press forming by the methods of related art, such as a steel sheet with a high strength of 590 MPa or higher or an aluminum alloy sheet, by executing the press forming method of this aspect, the curved channel part in which stretch flange deformation and generation of a wrinkle are restricted can be obtained.

<Blank Restraining Method>

In the press forming method of this aspect, the base section and the outer portion of the deformation section of the blank are individually restrained in the shear deformation step. The restraining method may employ a known method of related art. For example, there may be a method of fixing a blank by pinching the blank with a jig, a method of providing a protrusion on a die and hooking a blank to the protrusion, and a method of fixing a blank with a magnetic force. One of these methods may be employed or these methods may be combined and employed.

As a specific example, there may be a method of providing a screw such as a bolt in the jig that pinches the blank. With this method, a force for fastening the blank with the jig may be applied by a fastening force of the screw. Alternatively, a bead portion may be provided in the jig that pinches the blank. With this method, bending/unbending deformation and frictional resistance which are received by the material when the material moves through the bead portion may be used as a restraining force against the movement of the material. There may be also a method of making a protruding and depressed shape by knurling in the jig that pinches and fixes the blank. With this method, since the protruding and depressed shape bites into the blank, the movement of the material can be likely disturbed. The method of knurling processing may be a method of cutting, and transferring the protruding and depressed shape by strongly pressing the shape to the jig. However, any method may be employed as long as the protruding and depressed shape is provided in the jig.

If the portion of the jig with the protruding and depressed shape is hardened, wearing and chipping of the protruding and depressed shape can be prevented. The hardening method may be a method of applying hardening processing, such as high-frequency hardening, carburizing, flame hardening, or laser hardening; or a surface modifying method, such as low-temperature sulfurizing processing, a chemical vapor deposition method, or a physical vapor deposition method.

<Moving Method of Restrained Blank>

When the shear deformation step is executed with the configuration (3) or (4), the moving method while the outer portion of the blank is restrained may be a method of using a motion of slide of a press machine which is used by a typical press forming method, by converting the motion in the up-down direction into a motion made with the configuration (3) or (4). In this case, a mechanism using an inclined surface represented by a cam mechanism, a link mechanism, or a mechanism using a lever may be employed. In addition to the use of a driving force of the press machine, a method using a cylinder utilizing electricity, an air pressure, or a hydraulic pressure may be employed.

Advantageous Effects

With the press forming method of disclosed embodiments, when press forming is executed to obtain the press-formed part having the curved portion in the vertical wall portion, stretch flange deformation, which occurs in at least the vertical wall portion among the vertical wall portion and the flange portion can be restricted.

Accordingly, a crack due to the stretch flange deformation in the press-formed part having the curved portion in the vertical wall portion can be prevented from being generated. Also, the shear deformation step can be stably executed even if various variations are made during volume production. Accordingly, the shear deformation step can make significant contribution to decrease in defective rating of pressed products.

Further, by applying disclosed embodiments to a material with difficulty in press forming, such as a steel sheet with a high strength of 590 MPa or higher or an aluminum alloy sheet, press-formed parts with various shapes can be manufactured. Accordingly, the disclosed embodiments can make significant contribution to decrease in weight and increase in strength of parts.

DETAILED DESCRIPTION

Figure 3:
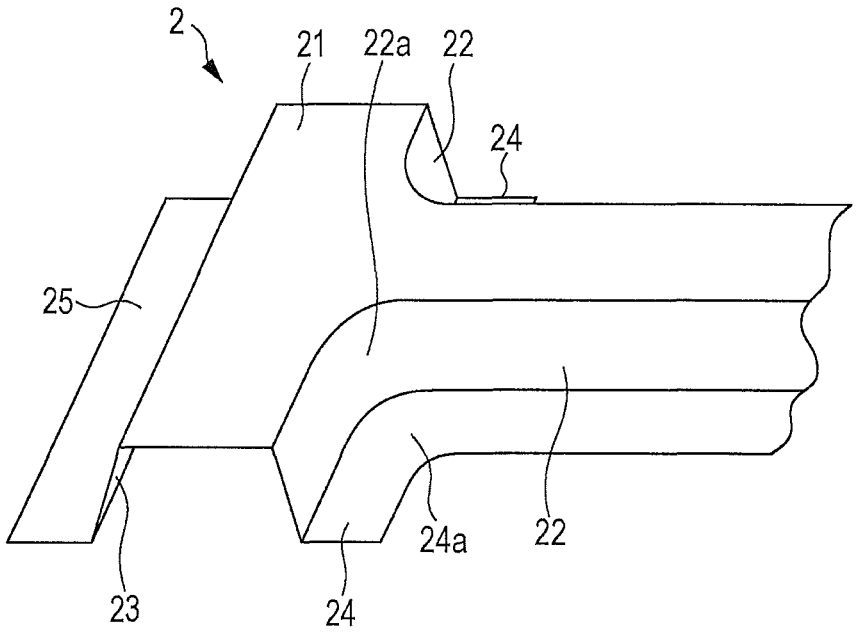
FIG. 3 is a perspective view showing a curved channel part manufactured in first to fifth embodiments.

Disclosed embodiments are described below; however, this disclosure is not limited to these embodiments. In the embodiments described below, a curved channel part is described as an example of a press-formed part being a subject to be manufactured. However, disclosed embodiments are not limited to the curved channel part. Any part may be a subject of embodiments as long as the part is a press-formed part having a vertical wall portion having a curved portion that is curved in a depressed shape toward a top portion during forming. FIG. 3 provides an example of a shape, in which a boundary portion between a top portion and a vertical wall portion is bent at a curved bending line to form a curved portion so that a vertical wall portion 22 is depressed toward a top portion 21, that is the vertical wall portion 22 is deformed by off-plane deformation (curved) in a direction in which the vertical wall portion 22 is drawn toward the top portion 21.

[First Embodiment]

In this embodiment, the curved channel part shown in FIG. 3 is manufactured. Such a curved channel part is used as, for example, a center pillar part of a vehicle.

As shown in FIG. 3, a curved channel part 2 includes a top portion 21 corresponding to a base section, a vertical wall portion 22 with a curved portion 22*a*, a vertical wall portion 23 without a curved portion, a flange portion 24 continuous to the vertical wall portion 22 with the curved portion 22*a*, and a flange portion 25 continuous to the vertical wall portion 23 without a curved portion. The flange portion 24 has a curved portion 24*a* in a portion continuous to the curved portion 22*a* of the vertical wall portion 22.

The vertical wall portion 22 with the curved portion 22*a* and the flange portion 24 continuous to the vertical wall portion 22 of the curved channel part 2 are formed by the following method. In this case, a portion other than the curved portion 22*a* may be formed in a typical deep drawing step. It is to be noted that the vertical wall portion 23 without a curved portion and the flange portion 25 continuous to the vertical wall portion 23 are formed in the typical deep drawing step.

Figure 4:
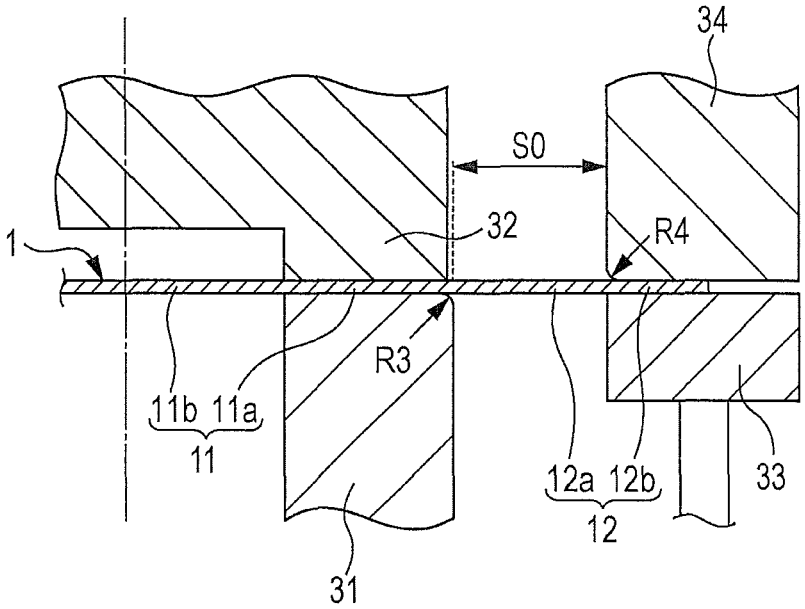
FIG. 4 is a cross-sectional view explaining a die and a blank used in an embodiment.

As shown in FIG. 4, a die used for press forming includes a punch 31 arranged below a blank 1 configuring a flat-sheet-shaped processing material, a first pad 32 arranged above the punch 31 with the blank 1 interposed therebetween, a blank holder 33 arranged at a lateral side of the punch 31 with a distance S0 interposed therebetween, and a second pad 34 arranged above the blank holder 33 with the blank 1 interposed therebetween. The installation distance S0 between the punch 31 and the second pad 34 is the same as the height of the vertical wall portion 22 of the curved channel part 2 to be manufactured.

The blank 1 is a uniform single sheet. As shown in FIG. 4, for convenience of description, if it is considered that the blank 1 is separated into a base section 11 which is not deformed and a deformation section 12 which is deformed by press forming, the deformation section 12 includes a portion 12*a* to be the vertical wall portion 22. Also, in this embodiment, since the curved channel part 2 having the flange portion 24 is manufactured, the deformation section 12 includes a portion to be the flange portion 24.

First, as shown in FIG. 4, a boundary-side portion (a portion of the base section 11 at the boundary side with respect to the deformation section 12) 11*a* of the base section 11 of the blank 1 is pinched and restrained by the punch 31 and the first pad 32, and an outer portion (the portion to be the flange portion) 12*b* of the deformation section 12 is pinched and restrained by the blank holder 33 and the second pad 34. A center portion 11*b* of the base section 11 may be restrained or may not be restrained. In this state, the punch 31 and the first pad 32, and the blank holder 33 and the second pad 34 are separated by the separation distance S0 when viewed in a thickness direction of the blank 1.

In this case, the punch 31 and the first pad 32 configure a first restraining section, and the blank holder 33 and the second pad 34 configure a second restraining section.

Figure 5:
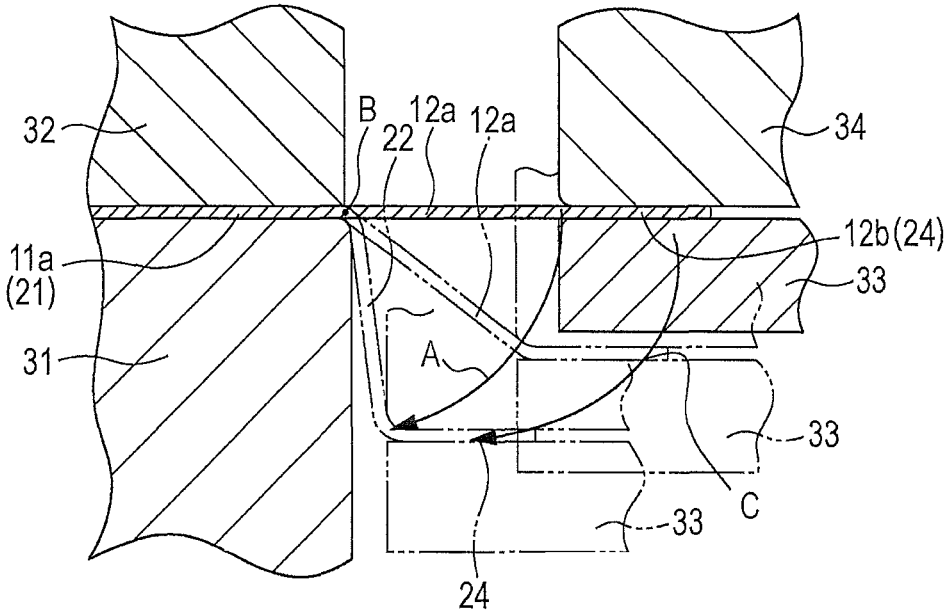
FIG. 5 is a cross-sectional view (corresponding to an A-A cross-sectional view of FIG. 1A) explaining a method of the first embodiment.

Then, as shown in FIG. 5, the blank holder 33 and the second pad 34 that restrain the outer portion 12*b* are moved along arrow A to approach the punch 31 and the first pad 32 while being turned relatively downward so that the portion 12*a* to be the vertical wall portion is rotated around a point (a bending point of the curved portion 22*a* of the vertical wall portion 22) B on the boundary line with respect to the boundary-side portion 11*a* as indicated by arrow A. This corresponds to a shear deformation step. With the shear deformation step, the portion 12*a* to be the vertical wall portion of the blank 1 is bent at the boundary between the boundary-side portion 11*a* and the outer portion 12*b*, and becomes the vertical wall portion 22 of the curved channel part 2.

Figure 1A:
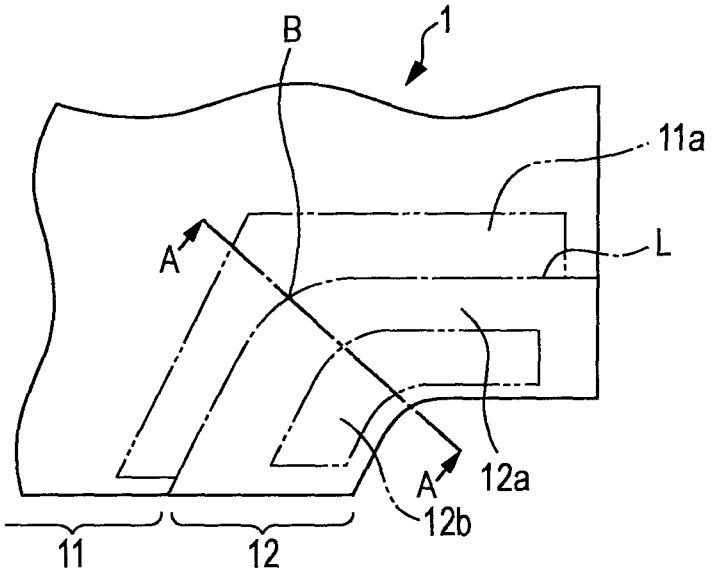
FIG. 1A and FIG. 1B provide illustrations explaining a press forming method of a curved channel part according to an embodiment.
Figure 1B:
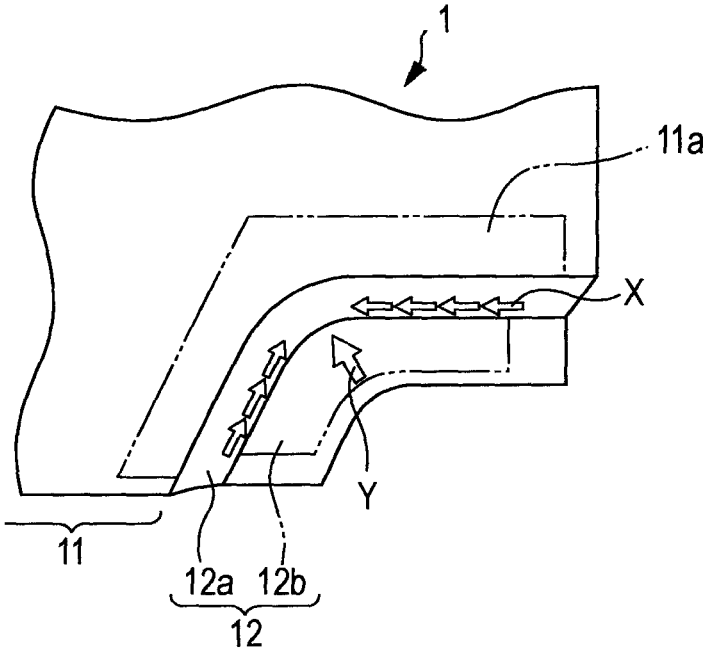
Figure 2:
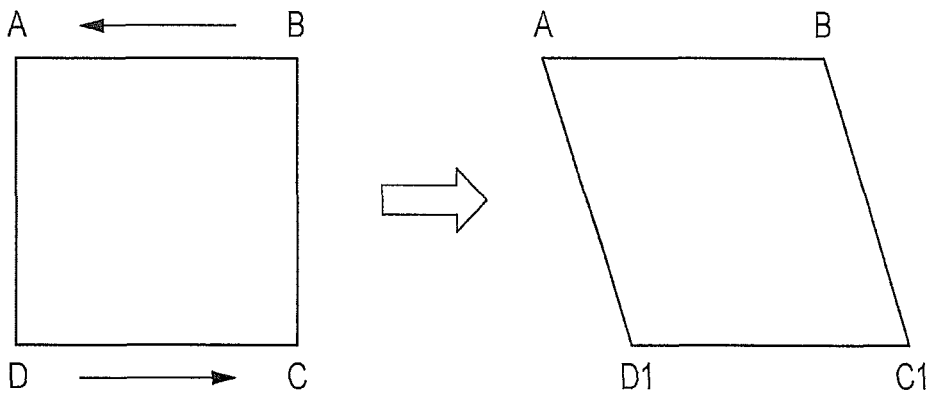
FIG. 2 is a schematic illustration explaining shear deformation.

In the sharing deformation step, as shown in FIG. 1B, in the blank 1, shear deformation occurs in the sheet face of the portion 12*a* to be the vertical wall portion of the deformation section 12 by the movement of the outer portion 12*b* indicated by arrow Y, and the material flows in a direction indicated by arrow X in an outer edge portion of the portion 12*a* to be the vertical wall portion. Hence, in the curved channel part 2 manufactured in this embodiment, stretch flange deformation hardly occurs in the outer edge portion of the curved portion 22*a* of the vertical wall portion 22.

Also, with the method of this embodiment, in the shear deformation step, the cross-sectional shape or the dimension of the portion 12*a* to be the vertical wall portion of the blank 1 is not changed in a portion other than the bent portion. Accordingly, a wrinkle is hardly generated in the vertical wall portion 22 of the curved channel part 2.

Further, since the outer portion 12*b* is moved while being restrained and hence becomes the flange portion 24, stretch flange deformation hardly occurs in the outer edge portion of the curved portion 24*a* of the flange portion 24, and a wrinkle is hardly generated in the flange portion 24.

[Second Embodiment]

Also in this embodiment, similarly to the first embodiment, the curved channel part 2 having the shape shown in FIG. 3 is manufactured. The vertical wall portion 22 with the curved portion 22*a* and the flange portion 24 continuous to the vertical wall portion 22 of the curved channel part 2 are formed by the following method shown in FIG. 6.

The method in this embodiment differs from the method in the first embodiment in the moving method of the blank holder 33 and the second pad 34 that restrain the outer portion 12*b*, and is similar to the method in the first embodiment for the other points.

Figure 6:
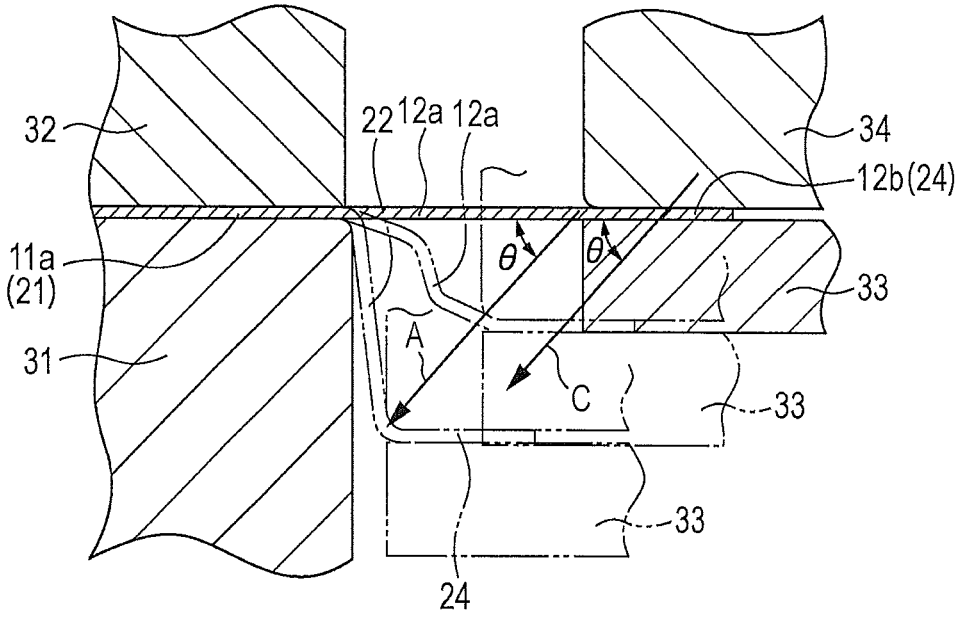
FIG. 6 is a cross-sectional view (corresponding to the A-A cross-sectional view of FIG. 1A) explaining a method of the second embodiment.

First, as indicated by a solid line in FIG. 6, the boundary-side portion 11*a* of the base section 11 of the blank 1 is pinched and restrained by the punch 31 and the first pad 32, and the outer portion (the portion to be the flange portion) 12*b* of the deformation section 12 is pinched and restrained by the blank holder 33 and the second pad 34.

Then, the blank holder 33 and the second pad 34 that restrain the outer portion 12*b* are linearly moved obliquely downward to approach the punch 31 and the first pad 32 when viewed in the thickness direction of the blank as indicated by arrow C in FIG. 6. To be specific, the blank holder 33 and the second pad 34 are linearly moved in an oblique direction in which an angle (θ) with respect to the sheet face of the blank 1 is in a range from 30° to 60°. Accordingly, the restrained outer portion 12*b* is linearly moved in the direction of θ=30° to 60°. This corresponds to the shear deformation step.

With this sharing deformation step, as indicated by a two-dot chain line in FIG. 6, not only the portion 12*a* to be the vertical wall portion of the blank 1 is bent at the boundary between the boundary-side portion 11*a* and the outer portion 12*b*, but also an intermediate portion is deformed in a contraction direction and then stretched, and the portion 12*a* finally becomes the vertical wall portion 22 of the curved channel part 2. Meanwhile, a portion, which is near the boundary with respect to the outer portion 12*b*, of the portion 12*a* to be the vertical wall portion is moved along arrow A in FIG. 6 while being bent.

In the sharing deformation step, as shown in FIG. 1B, in the blank 1, shear deformation occurs in the sheet face of the portion 12*a* to be the vertical wall portion of the deformation section 12 by the movement of the outer portion 12*b* indicated by arrow Y, and the material flows in the direction indicated by arrow X in the outer edge portion of the portion 12*a* to be the vertical wall portion. In FIG. 6, it is to be noted that the shear deformation direction is a direction perpendicular to the paper face.

Hence, in the curved channel part 2 manufactured in this embodiment, stretch flange deformation hardly occurs in the outer edge portion of the curved portion 22*a* of the vertical wall portion 22.

With the method in this embodiment, in the shear deformation step, the cross-sectional shape of the portion 12*a* to be the vertical wall portion of the blank 1 is changed. If the outer portion 12*b* is moved by θ=45°, even when press forming is executed at a room temperature, a wrinkle that may cause a problem in quality is hardly present in the vertical wall portion 22 of the curved channel part 2.

If the moving angle (θ) of the outer portion 12*b* with respect to the sheet face of the blank 1 is not 45°, as compared with the case of θ=45°, a possibility of that a wrinkle and a crack are generated in the vertical wall portion 22 increases. If θ is in the range from 30° to 60°, a crack caused by a stretch generated in the vertical wall portion 22 can be avoided, and a wrinkle generated in the vertical wall portion 22 can be removed by post-processing etc.

Further, since the outer portion 12*b* is moved while being restrained and hence becomes the flange portion 24, stretch flange deformation hardly occurs in the outer edge portion of the curved portion 24*a* of the flange portion 24, and a wrinkle is hardly generated in the flange portion 24.

Also, if the portion 12*a* to be the vertical wall portion is further moved from the state in FIG. 6 and is pinched by a side surface of the punch 31 and a side surface of the second pad 34, a wrinkle generated in the portion 12*a* to be the vertical wall portion in the state in FIG. 6 can be stretched by pinching the wrinkle by the side surface of the punch 31 and the side surface of the second pad 34.

[Third Embodiment]

Also in this embodiment, similarly to the first embodiment, the curved channel part 2 having the shape shown in FIG. 3 is manufactured. The vertical wall portion 22 with the curved portion 22*a* and the flange portion 24 continuous to the vertical wall portion 22 of the curved channel part 2 are formed by the following method shown in FIG. 7.

Figure 7:
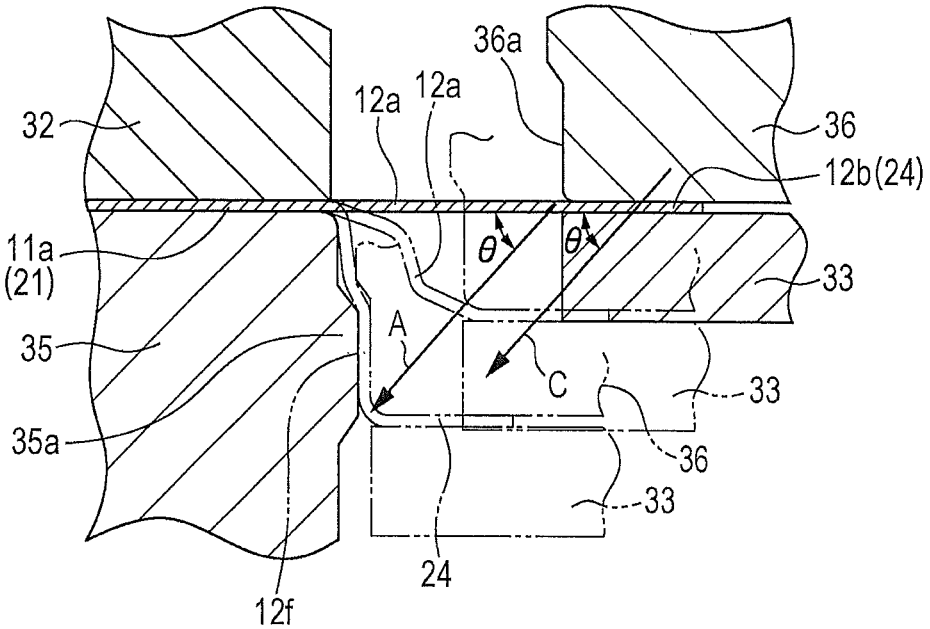
FIG. 7 is a cross-sectional view (corresponding to the A-A cross-sectional view of FIG. 1A) explaining a method of the third embodiment.

As shown in FIG. 7, a die to be used for press forming is similar to that in FIG. 4; however, as shown in FIG. 7, a punch 35 having a protruding portion 35*a* at a side surface (a pressing surface that contacts the vertical wall portion) is arranged below the blank 1. A second pad 36 having a depressed portion 36*a* at a side surface is arranged above the blank holder 33. The other points are similar to the second embodiment.

Similarly to the method of the second embodiment, the blank holder 33 and the second pad 36 that restrain the outer portion 12*b* are linearly moved obliquely downward in which the angle (θ) with respect to the sheet face of the blank 1 is in the range from 30° to 60° as indicated by arrow C. By the linear movement, shear deformation occurs in the sheet face of the portion 12*a* to be the vertical wall portion of the blank 1, and as indicated by a two-dot chain line in FIG. 7, the cross-sectional shape of the portion 12*a* to be the vertical wall portion of the blank 1 is changed. Meanwhile, a portion, which is near the boundary with respect to the outer portion 12*b*, of the portion 12*a* to be the vertical wall portion is moved along arrow A in FIG. 7 while being bent.

Then, by moving the blank holder 33 and the second pad 36, finally, a portion 12*f* of the portion 12*a* to be the vertical wall portion is pinched by the protruding portion 35*a* of the punch 35 and the depressed portion 36*a* of the second pad 36, and becomes a surface substantially perpendicular to a surface of the flange portion 24. This step is a wrinkle stretching step.

At this time, if a wrinkle is generated in the vertical wall portion when the vertical wall portion is pinched by the die, the wrinkle is likely stretched. In particular, the line length of the portion 12*a* to be the vertical wall portion is elongated by the amount corresponding to the depressed portion 36*a*, that is, the line length can be increased. As the result, even if a wrinkle is generated in the vertical wall portion, the wrinkle can be stretched.

The wrinkle stretching step may be executed at last after the shear deformation step described in the first embodiment etc. Since the wrinkle stretching step is executed continuously to the shear deformation step, the number of steps can be prevented from being increased for the wrinkle stretching step.

[Fourth Embodiment]

Also in this embodiment, similarly to the first embodiment, the curved channel part 2 having the shape shown in FIG. 3 is manufactured. The vertical wall portion 22 with the curved portion 22*a* and the flange portion 24 continuous to the vertical wall portion 22 of the curved channel part 2 are formed by the following method shown in FIG. 8.

In this embodiment, the vertical wall portion 22 is formed by two steps including the shear deformation step and then a deep drawing step. Hence, the outer portion 12*b* that is restrained in the shear deformation step includes a portion of the portion to be the vertical wall portion 22. Also, an inner portion (a portion near the base section 11) 12*c* being a portion to be the vertical wall portion 22 is shear-deformed in the sheet face.

Figure 8A:
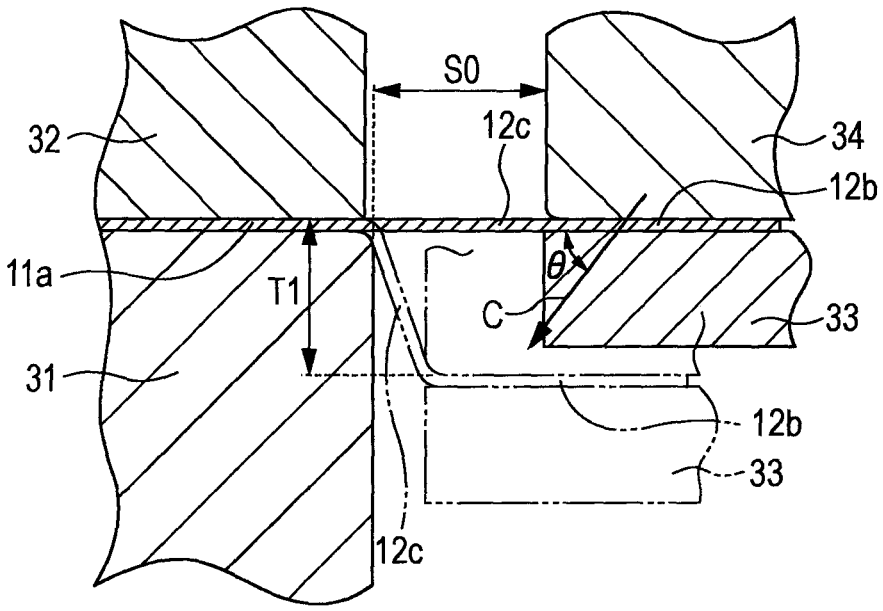
FIG. 8A and FIG. 8B provide cross-sectional views (corresponding to the A-A cross-sectional view of FIG. 1A) explaining a method of the fourth embodiment.

A die used in the shear deformation step is basically the same as that of the second embodiment. As shown in FIG. 8A, the installation distance S0 between the punch 31 and the second pad 34 is a value corresponding to a half of a height T2 (see FIG. 8B) of the vertical wall portion 22 of the curved channel part 2 to be manufactured or a value obtained by adding or subtracting a previously set margin amount to and from the half of the height T2.

First, the boundary-side portion 11*a* of the base section 11 of the blank 1 is pinched and restrained by the punch 31 and the first pad 32, and the outer portion (the portion of the portion to be the vertical wall portion 22 and the portion to be the flange portion 24) 12*b* of the deformation section 12 is pinched and restrained by the blank holder 33 and the second pad 34.

Then, similarly to the method of the second embodiment, the blank holder 33 and the second pad 34 that restrain the outer portion 12*b* are linearly moved in a direction in which the angle (θ) with respect to the sheet face of the blank 1 is in the range from 30° to 60° as indicated by arrow C in FIG. 8A. Accordingly, the restrained outer portion 12*b* is linearly moved in the direction at θ=30° to 60°, and shear deformation occurs in the sheet face of the inner portion 12*c* of the blank 1. This corresponds to the shear deformation step.

This shear deformation step is executed until a timing before the angle between the boundary-side portion 11*a* of the base section 11 and the inner portion 12*c* of the deformation section 12 reaches an angle of a final product.

Figure 8B:
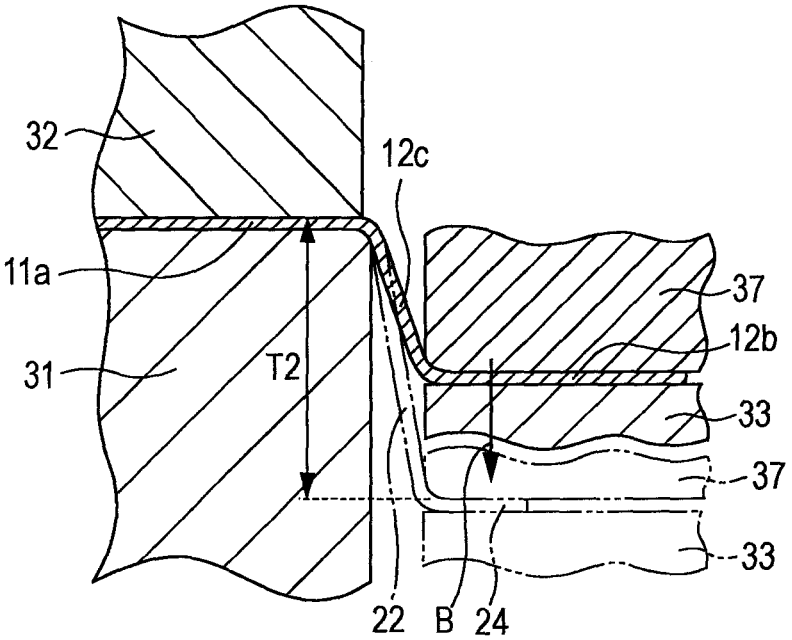

Then, as shown in FIG. 8B, a die 37 is arranged instead of the second pad 34 that restrains the outer portion 12*b*, the die 37 and the blank holder 33 are moved along arrow B, and thus the deep drawing step is executed. Accordingly, the outer portion 12*b* is stretched while being drawn toward the punch 31, and the inner portion 12*c* is also drawn and stretched. Thus, the vertical wall portion 22 is formed.

[Fifth Embodiment]

Also in this embodiment, similarly to the first embodiment, the curved channel part 2 having the shape shown in FIG. 3 is manufactured. The vertical wall portion 22 with the curved portion 22*a* and the flange portion 24 continuous to the vertical wall portion 22 of the curved channel part 2 are formed by the following method shown in FIG. 9.

In this embodiment, the vertical wall portion 22 is formed by two steps including the deep drawing step and then the shear deformation step.

Figure 9A:
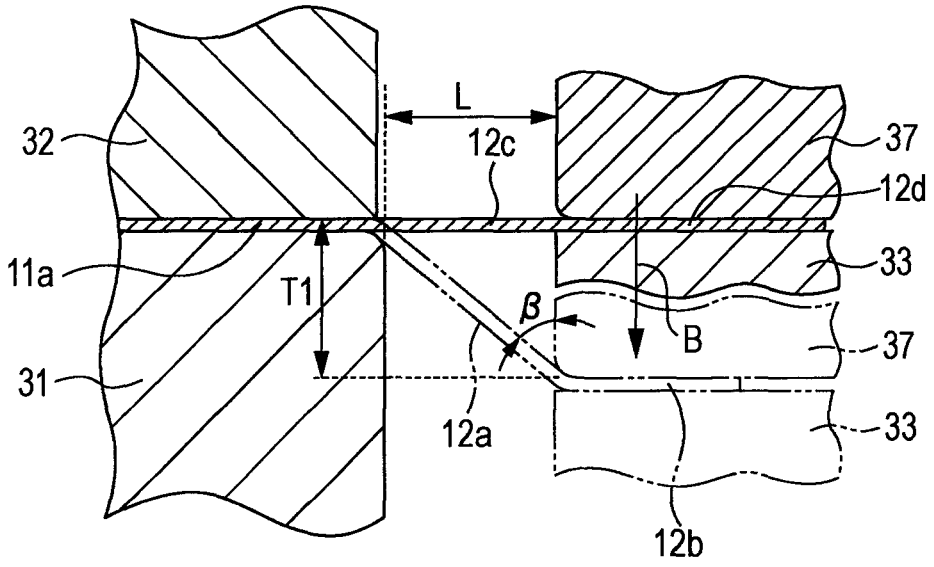
FIG. 9A and FIG. 9B provide cross-sectional views (corresponding to the A-A cross-sectional view of FIG. 1A) explaining a method of the fifth embodiment.

First, as shown in FIG. 9A, the boundary-side portion 11*a* of the base section 11 of the blank 1 is pinched and restrained by the punch 31 and the first pad 32, and an outer portion 12*d* of the deformation section 12 (the portion of the portion 12*a* to be the vertical wall portion 22 and the portion to be the flange portion 24) is pinched by the die 37 and the blank holder 33. In this state, the inner portion 12*c* of the deformation section 12 of the blank 1 is present while not being restrained. Then, the deep drawing step is executed by moving the die 37 and the blank holder 33 along arrow B while a predetermined tensile force is applied to the outer portion 12*d*.

Accordingly, the outer portion 12*d* is bent while being drawn and stretched toward the punch 31, and the blank 1 obtains a shape having a bent portion between the portion 12*a* to be the vertical wall portion and the outer portion 12*b*. The deep drawing step is executed until an angle β between the portion 12*a* to be the vertical wall portion and a side surface of the die 37 becomes, for example, in a range from 45° to 60°.

Figure 9B:
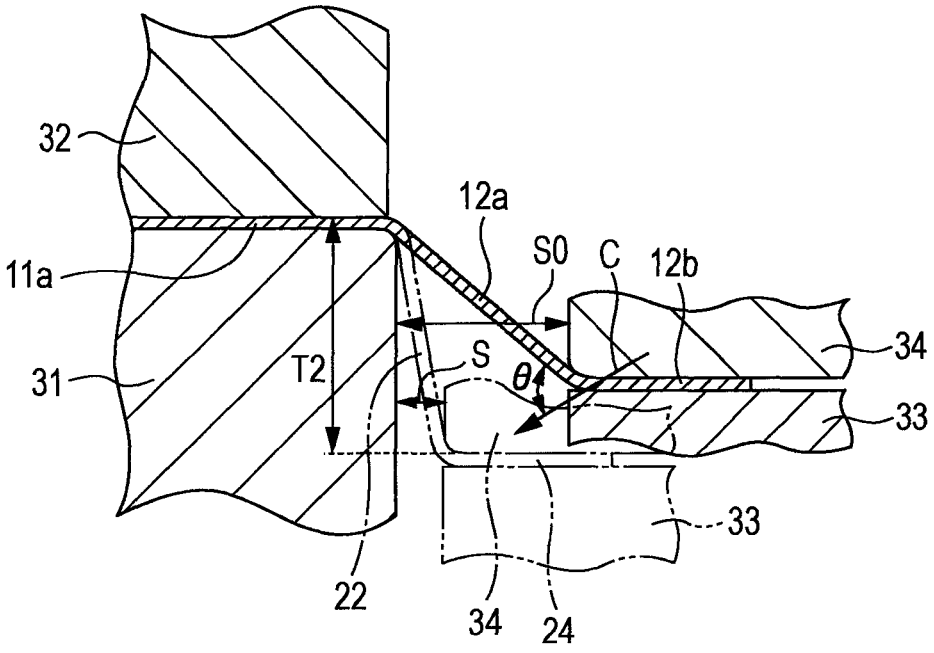

Then, as shown in FIG. 9B, the outer portion 12*b* is restrained by the blank holder 33 and the second pad 34, and the blank holder 33 and the second pad 34 are linearly moved in a direction in which the angle (θ) with respect to the sheet face of the blank 1 becomes in the range from 30° to 60°. Accordingly, the restrained outer portion 12*b* is linearly moved in the direction of θ=30° to 60°. By the linear movement, shear deformation occurs in the sheet face of the portion 12*a* to be the vertical wall portion of the blank 1, and the vertical wall portion 22 and the flange portion 24 are formed. This corresponds to the shear deformation step.

[Sixth Embodiment]

Figure 10:
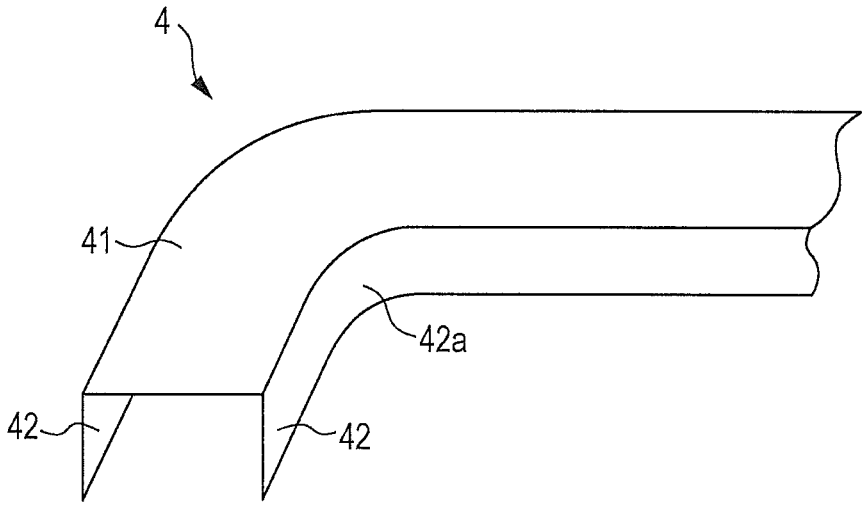
FIG. 10 is a perspective view showing a curved channel part manufactured in a sixth embodiment.

In this embodiment, a curved channel part shown in FIG. 10 is manufactured. Such a curved channel part is used as, for example, a lower arm part of a vehicle.

As shown in FIG. 10, a curved channel part 4 includes a top portion 41, and a vertical wall portion 42 with a curved portion 42*a*. In this embodiment, the vertical wall portion 42 is formed by two steps including a shear deformation step and a stamping step. The basic configuration of a die used in the shear deformation step is the same as the second embodiment.

Figure 11A:
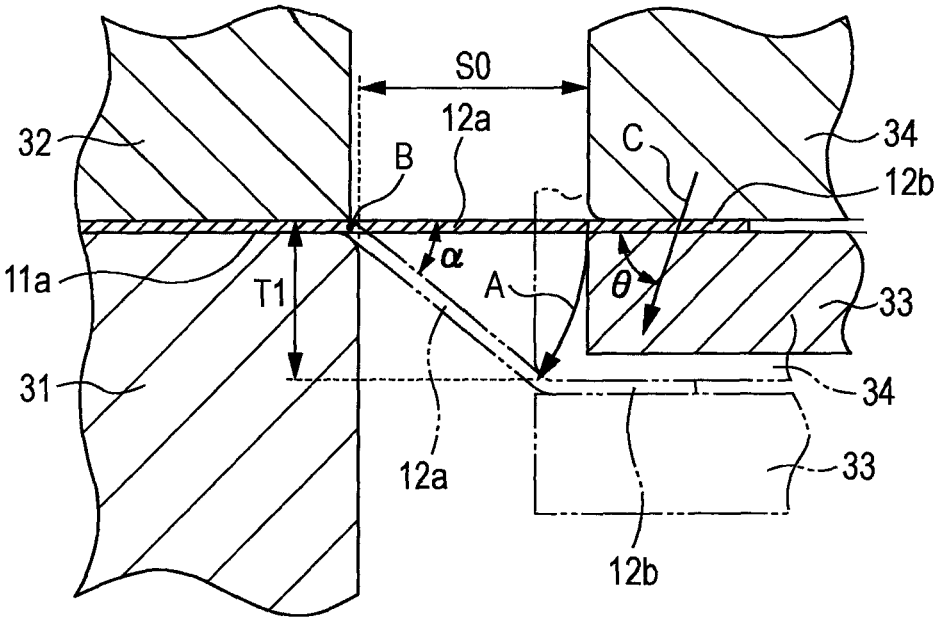
FIG. 11A and FIG. 11B provide cross-sectional views (corresponding to the A-A cross-sectional view of FIG. 1A) explaining a method of the sixth embodiment.

As shown in FIG. 11A, first, the boundary-side portion 11*a* of the base section 11 of the blank 1 is pinched and restrained by the punch 31 and the first pad 32, and the outer portion (the portion to be transiently the flange portion) 12*b* of the deformation section 12 is pinched and restrained by the blank holder 33 and the second pad 34. In this state, similarly to the other embodiments, the punch 31 and the first pad 32, and the blank holder 33 and the second pad 34 are separated by the separation distance S0 when viewed in the thickness direction of the blank 1.

Then, the blank holder 33 and the second pad 34 restraining the outer portion 12*b* are moved so that the portion 12*a* to be the vertical wall portion is rotated around the boundary point B with respect to the boundary-side portion 11*a* as indicated by arrow A. This corresponds to the shear deformation step. This movement is stopped at a position at which the portion 12*a* to be the vertical wall portion is bent by a predetermined angle (α, α being preferably in a range from 20° to 70°, in FIG. 11A, α=40°). In this state, the portion 12*a* to be the vertical wall portion becomes an inclined wall portion, and the outer portion 12*b* becomes a flange portion. It is to be noted that, if α is smaller than 20°, shear deformation is decreased, and the effect of restricting occurrence of stretch flange deformation is decreased. Also, if α exceeds 70°, shear deformation occurs sufficiently in the shear deformation step for forming the vertical wall, forming does not have to be executed in the two steps of the shear deformation step and the stamping step.

Figure 11B:
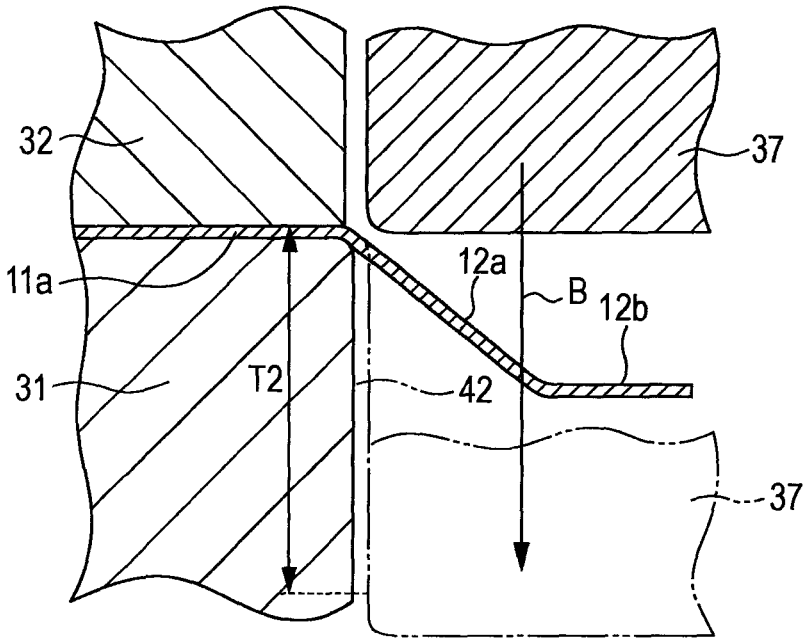

Then, as shown in FIG. 11B, the second pad 34 and the blank holder 33 restraining the outer portion 12*b* are released, and the die 37 is arranged on the portion 12*a* to be the vertical wall portion and the outer portion 12*b*. Then, by moving the die 37 along arrow B, the bent portion is stretched and hence the vertical wall portion 42 is formed. This corresponds to the stamping step.

It is to be noted that the shear deformation step that is executed before the stamping step may be executed by linearly moving the restrained outer portion 12*b* in the direction in which the angle (θ) with respect to the sheet face of the blank 1 is in the range from 30° to 60° as indicated by arrow C in FIG. 11A.

Also, the curved channel part shown in FIG. 10 may be manufactured by a method of cutting the flange portion 24 after a flanged formed part is once obtained by the method of the first embodiment or the second embodiment.

[Other Embodiment]

Figure 12A:
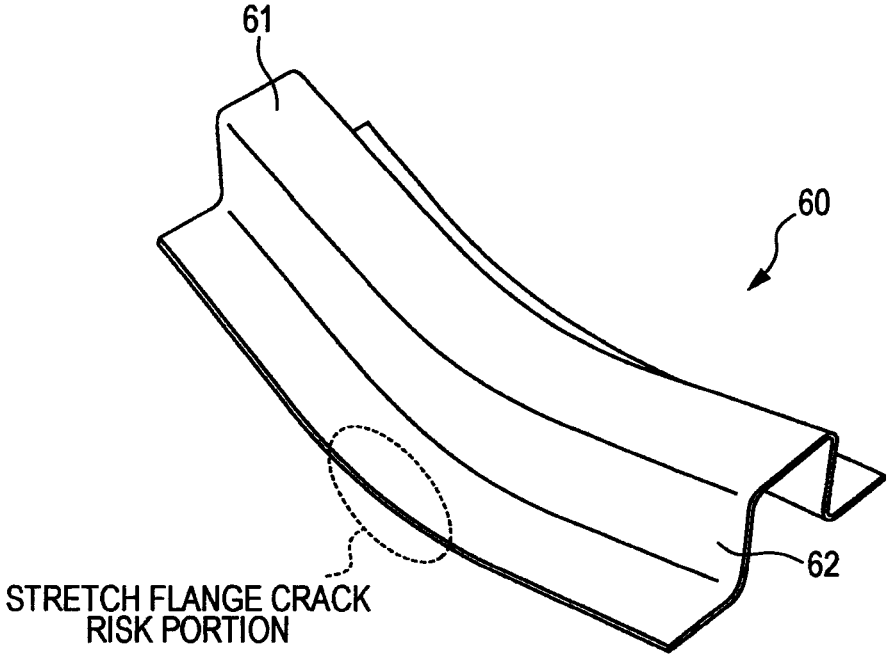
FIG. 12A and FIG. 12B provide illustrations showing another example of a curved channel part being a subject of disclosed embodiments, (FIG. 12A) being a perspective view, (FIG. 12B) being a side view.
Figure 12B:
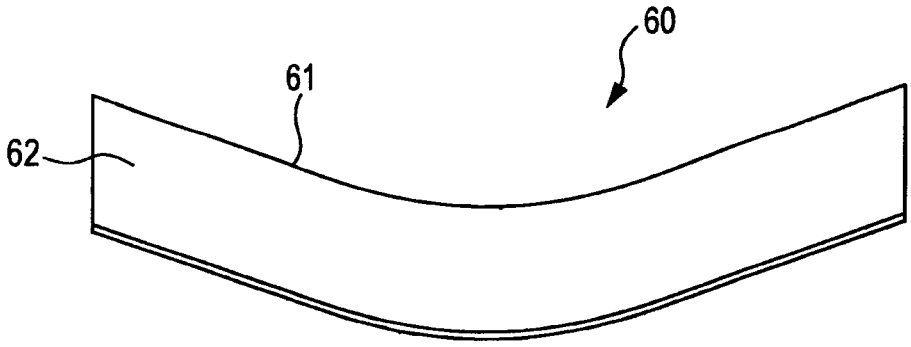

FIG. 12 shows another embodiment of a curved channel part.

As shown in FIG. 12, this curved channel part 60 is an example in which a curved portion is formed so that a vertical wall portion 62 is depressed toward a top portion 61, that is, by deforming the vertical wall portion 62 by in-plane deformation (curving the vertical wall portion 62) in a height direction so that the vertical wall portion 62 is depressed toward the top portion 61, when the boundary portion between the top portion 61 and the vertical wall portion 62 is bent at a curved bending line. By the curve of the vertical wall portion, the top portion 61 also obtains a curved shape to be depressed toward the vertical wall portion.

Even in this curved channel part 60, stretch flange deformation likely occurs. By employing press forming according to embodiments (for example, press forming described in the first to sixth embodiments), a crack due to stretch flange can be restricted.

Since the top portion 61 is also curved, facing surfaces of the punch 31 and the first pad 32 for holding the blank have surface shapes along the curved top portion.

Also, even if the curve of the vertical wall portion is a curved portion deformed in both directions of an off-plane direction and a vertical direction, the curved portion may be a subject of disclosed embodiments.

EXAMPLES

By the method described in any of the first to sixth embodiments and a press forming method of related art (deep drawing), the vertical wall portion 22 and the flange portion 24 continuous to the vertical wall portion 22 of the curved channel part 2 shown in FIG. 3 were formed. Also, by the method described in the sixth embodiment and a press forming method of related art (stamping), the curved channel part 4 shown in FIG. 10 was formed.

In deep drawing, a material located at the flange portion is drawn into the vertical wall portion, and hence the shape of the flange portion after forming is different from the method of any of the first to fifth embodiments. The shapes of the blanks were changed between the methods according to the first to fifth embodiments and the deep drawing, so that the flange width near the curved portion of the vertical wall portion was 50 mm after press forming. The shape of the blank for deep drawing was obtained by inverse analysis based on the total strain theory.

Also, for the blank, blanks of five types of materials shown in Table 1 each having a thickness of 1.2 mm were prepared.

TABLE 1

| Sign | Material | Thickness (mm) | Ts (Tensile strength) (MPa) |
|---|---|---|---|
| 270 | 270 MPa grade steel sheet | 1.2 | 301 |
| 590 | 590 MPa grade steel sheet | 1.2 | 602 |
| 980 | 980 MPa grade steel sheet | 1.2 | 985 |
| 1180 | 1180 MPa grade steel sheet | 1.2 | 1183 |
| Al | Aluminum alloy sheet | 1.2 | 297 |

It is to be noted that a blank was heated by using a heating furnace, and the temperature of the blank before forming was measured by using an infrared radiation thermometer.

<Sample No. 1-1>

The vertical wall portion 22 and the flange portion 24 continuous to the vertical wall portion 22 of the curved channel part 2 shown in FIG. 3 were formed only in the shear deformation step by the method of the first embodiment shown in FIG. 5.

Figure 13A:
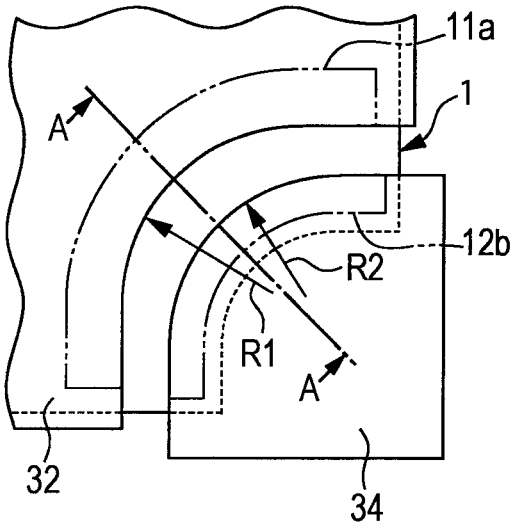
FIG. 13A and FIG. 13B provide a plan view (FIG. 13A) explaining a method of the disclosed embodiments executed in an example, and an A-A cross-sectional view (FIG. 13B) thereof.
Figure 13B:
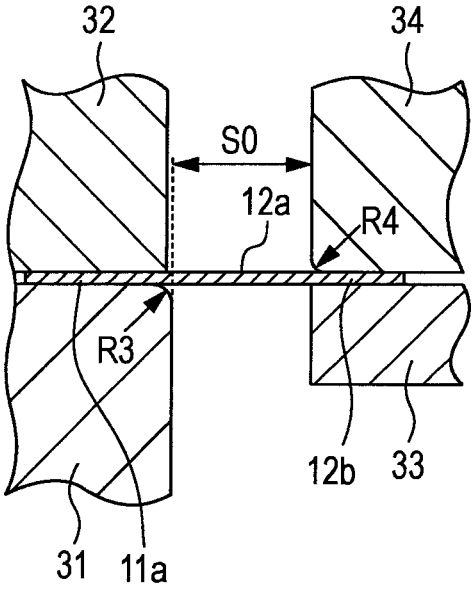

FIG. 13A is a plan view of the used die and blank. FIG. 13B is an A-A cross-sectional view thereof.

Portions of inner peripheral surfaces of the punch 31 and the first pad 32, the portions which correspond to the curved portion 22*a*, each have a curvature radius R1 of 100 mm. Portions of outer peripheral surfaces of the blank holder 33 and the second pad 34, the portions which correspond to the curved portion 22*a*, each have a curvature radius R2 of 90 mm. The arrangement distance S0 between the punch 31 and the second pad 34 shown in FIG. 13B was set at 100 mm. A chamfering radius R3 of an upper-end corner portion of the punch 31 was set at 10 mm, and a chamfering radius R4 of a lower-end corner portion of the second pad 34 was set at 10 mm.

As shown in FIGS. 5 and 13A, first, the boundary-side portion 11*a* of the base section 11 of the blank 1 was pinched and restrained by the punch 31 and the first pad 32, and the outer portion (the portion to be the flange portion) 12*b* of the deformation section 12 was pinched and restrained by the blank holder 33 and the second pad 34.

Figure 14A:
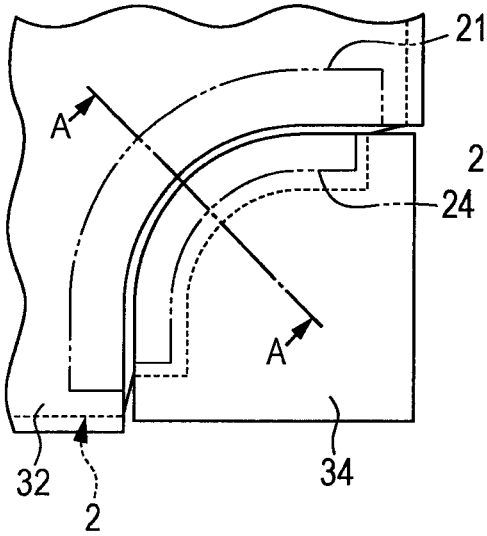
FIG. 14A and FIG. 14B provide a plan view (FIG. 14A) explaining a method of the disclosed embodiments executed in an example, and an A-A cross-sectional view (FIG. 14B) thereof.
Figure 14B:
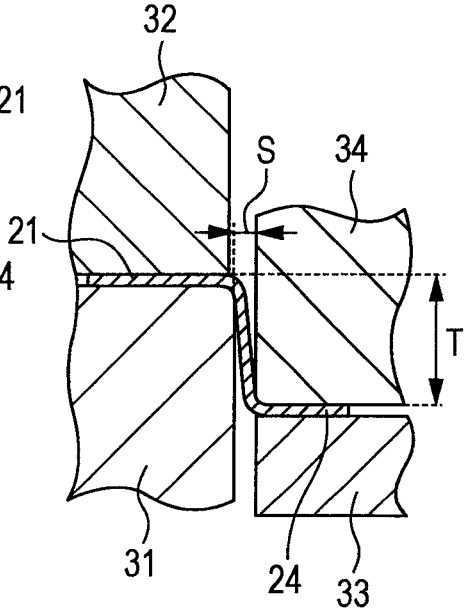

Then, by moving the blank holder 33 and the second pad 34 along arrow C in FIG. 5, the portion 12*a* to be the vertical wall portion was rotated along arrow A in FIG. 5. As shown in FIG. 14B, the rotation was executed until a distance S between the punch 31 and the second pad 34 became 10 mm. Accordingly, the portion 12*a* to be the vertical wall portion of the blank 1 was shear-deformed and the vertical wall portion 22 was formed. FIG. 14
A, is a plan view of the die and blank in this state. FIG. 14B, is an A-A cross-sectional view thereof. A height T of the vertical wall portion 22 in FIG. 14B, was 100 mm.

In this example, the shear deformation step was executed at a room temperature by using a non-heated blank.

For the obtained curved channel part, a generated crack was evaluated as shown in Table 2, and a generated wrinkle was evaluated as shown in Table 3.

TABLE 2

| Sign | Crack evaluation |
|---|---|
| ○ | No crack |
| Δ | Necking |
| X (F) | Crack in flange portion |
| X (K) | Crack in vertical wall portion |

TABLE 3

| Sign | Wrinkle evaluation |
|---|---|
| ⊙ | No wrinkle at all by visual inspection |
| ○ | Very small wrinkle negligible in quality |
| X | Noticeable wrinkle |

As the result, with any of the materials of the used blank, the crack was O (no crack), and the wrinkle was O (very small wrinkle negligible in quality).

<Sample No. 1-2>

The vertical wall portion 22 and the flange portion 24 continuous to the vertical wall portion 22 of the curved channel part 2 shown in FIG. 3 were manufactured by the same method as the sample No. 1-1 except the following point.

In this example, from the state in FIG. 14B, a wrinkle stretching step was executed by further pinching the vertical wall portion 22 by the punch 31 and the second pad 34.

For the obtained curved channel part, a generated crack and a generated wrinkle were evaluated on the basis of Tables 2 and 3. As the result, with any of the materials of the used blank, the crack was O (no crack), and the wrinkle was ⊙ (no wrinkle at all by visual inspection).

<Sample No. 1-3>

The vertical wall portion 22 and the flange portion 24 continuous to the vertical wall portion 22 of the curved channel part 2 shown in FIG. 3 were manufactured by the same method as the sample No. 1-1 except the following point.

In this example, the shear deformation step was executed by using a blank heated at 300° C.

For the obtained curved channel part, a generated crack and a generated wrinkle were evaluated on the basis of Tables 2 and 3. As the result, with any of the materials of the used blank, the crack was O (no crack), and the wrinkle was ⊙ (no wrinkle at all by visual inspection).

<Sample No. 1-4>

The vertical wall portion 22 and the flange portion 24 continuous to the vertical wall portion 22 of the curved channel part 2 shown in FIG. 3 were manufactured by the same method as the sample No. 1-1 except the following point.

In this example, the shear deformation step was executed by using a blank heated at 300° C. Also, from the state in FIG. 14B, the wrinkle stretching step was executed by further pinching the vertical wall portion 22 by the punch 31 and the second pad 34.

For each obtained curved channel part, a generated crack and a generated wrinkle were evaluated on the basis of Tables 2 and 3. As the result, with any of the materials of the used blank, the crack was O (no crack), and the wrinkle was ⊙ (no wrinkle at all by visual inspection).

<Sample No. 2-1>

The vertical wall portion 22 and the flange portion 24 continuous to the vertical wall portion 22 of the curved channel part 2 shown in FIG. 3 were formed only in the shear deformation step by the method of the second embodiment shown in FIG. 6.

A die the same as that of the sample No. 1-1 was used except that a moving mechanism of the blank holder 33 and the second pad 34 was different. The arrangement distance S0 between the punch 31 and the second pad 34 shown in FIG. 13B was set at 100 mm.

First, the boundary-side portion 11*a* of the base section 11 of the blank 1 was pinched and restrained by the punch 31 and the first pad 32, and the outer portion (the portion to be the flange portion) 12*b* of the deformation section 12 was pinched and restrained by the blank holder 33 and the second pad 34.

Then, as shown in FIG. 6, the blank holder 33 and the second pad 34 were linearly moved along arrow C. At this time, the moving angle (θ) with respect to the sheet face of the blank 1 was set at 30°. As shown in FIG. 14B, the movement was executed until a distance S between the punch 31 and the second pad 34 became 10 mm. Accordingly, the portion 12*a* to be the vertical wall portion was shear-deformed and the vertical wall portion 22 was formed. FIG. 14A is the plan view of the die and blank in this state. FIG. 14B is the A-A cross-sectional view thereof. The height T of the vertical wall portion 22 in FIG. 14B was 100 mm.

In this example, the shear deformation step was executed at a room temperature by using a non-heated blank.

For the obtained curved channel part, a generated crack and a generated wrinkle were evaluated on the basis of Tables 2 and 3. As the result, with any of the materials of the used blank, the crack was O (no crack), and the wrinkle was O (very small wrinkle negligible in quality).

<Sample No. 2-2>

The vertical wall portion 22 and the flange portion 24 continuous to the vertical wall portion 22 of the curved channel part 2 shown in FIG. 3 were manufactured by the same method as the sample No. 2-1 except the following point.

In this example, from the state in FIG. 14B, the wrinkle stretching step was executed by further pinching the vertical wall portion 22 by the punch 31 and the second pad 34.

For the obtained curved channel part, a generated crack and a generated wrinkle were evaluated on the basis of Tables 2 and 3. As the result, with any of the materials of the used blank, the crack was O (no crack), and the wrinkle was ⊙ (no wrinkle at all by visual inspection).

<Sample No. 2-3>

The vertical wall portion 22 and the flange portion 24 continuous to the vertical wall portion 22 of the curved channel part 2 shown in FIG. 3 were manufactured by the same method as the sample No. 2-1 except the following point.

In this example, the shear deformation step was executed by using a blank heated at 300° C.

For the obtained curved channel part, a generated crack and a generated wrinkle were evaluated on the basis of Tables 2 and 3. As the result, with any of the materials of the used blank, the crack was O (no crack), and the wrinkle was ⊙ (no wrinkle at all by visual inspection).

<Sample No. 2-4>

The vertical wall portion 22 and the flange portion 24 continuous to the vertical wall portion 22 of the curved channel part 2 shown in FIG. 3 were manufactured by the same method as the sample No. 2-1 except the following point.

In this example, the shear deformation step was executed by using a blank heated at 300° C. Also, from the state in FIG. 14B, the wrinkle stretching step was executed by further pinching the vertical wall portion 22 by the punch 31 and the second pad 34.

For the obtained curved channel part, a generated crack and a generated wrinkle were evaluated on the basis of Tables 2 and 3. As the result, with any of the materials of the used blank, the crack was O (no crack), and the wrinkle was ⊙ (no wrinkle at all by visual inspection).

<Sample No. 3-1>

The vertical wall portion 22 and the flange portion 24 continuous to the vertical wall portion 22 of the curved channel part 2 shown in FIG. 3 were manufactured by the same method as the sample No. 2-1 except the following point.

As shown in FIG. 6, the angle (θ) at which the blank holder 33 and the second pad 34 were linearly moved along arrow C was set at 45°.

For the obtained curved channel part, a generated crack and a generated wrinkle were evaluated on the basis of Tables 2 and 3. In the case of the sample No. 3-1, with any of the materials of the used blank, the crack was O (no crack), and the wrinkle was O (very small wrinkle negligible in quality).

<Sample No. 3-2>

The vertical wall portion 22 and the flange portion 24 continuous to the vertical wall portion 22 of the curved channel part 2 shown in FIG. 3 were manufactured by the same method as the sample No. 2-2 except the following point.

As shown in FIG. 6, the angle (θ) at which the blank holder 33 and the second pad 34 were linearly moved along arrow C was set at 45°.

For the obtained curved channel part, a generated crack and a generated wrinkle were evaluated on the basis of Tables 2 and 3. As the result, with any of the materials of the used blank, the crack was O (no crack), and the wrinkle was ⊙ (no wrinkle at all by visual inspection).

<Sample No. 3-3>

The vertical wall portion 22 and the flange portion 24 continuous to the vertical wall portion 22 of the curved channel part 2 shown in FIG. 3 were manufactured by the same method as the sample No. 2-3 except the following point.

As shown in FIG. 6, the angle (θ) at which the blank holder 33 and the second pad 34 were linearly moved along arrow C was set at 45°.

For the obtained curved channel part, a generated crack and a generated wrinkle were evaluated on the basis of Tables 2 and 3. As the result, with any of the materials of the used blank, the crack was O (no crack), and the wrinkle was ⊙ (no wrinkle at all by visual inspection).

<Sample No. 3-4>

The vertical wall portion 22 and the flange portion 24 continuous to the vertical wall portion 22 of the curved channel part 2 shown in FIG. 3 were manufactured by the same method as the sample No. 2-4 except the following point.

As shown in FIG. 6, the angle (θ) at which the blank holder 33 and the second pad 34 were linearly moved along arrow C was set at 45°.

For the obtained curved channel part, a generated crack and a generated wrinkle were evaluated on the basis of Tables 2 and 3. As the result, with any of the materials of the used blank, the crack was O (no crack), and the wrinkle was ⊙ (no wrinkle at all by visual inspection).

<Sample No. 4-1>

The vertical wall portion 22 and the flange portion 24 continuous to the vertical wall portion 22 of the curved channel part 2 shown in FIG. 3 were manufactured by the same method as the sample No. 2-1 except the following point.

As shown in FIG. 6, the angle (θ) at which the blank holder 33 and the second pad 34 were linearly moved along arrow C was set at 60°.

For the obtained curved channel part, a generated crack and a generated wrinkle were evaluated on the basis of Tables 2 and 3. In the case of the sample No. 4-1, with any of the materials of the used blank, the crack was O (no crack), and the wrinkle was O (very small wrinkle negligible in quality).

<Sample No. 4-2>

The vertical wall portion 22 and the flange portion 24 continuous to the vertical wall portion 22 of the curved channel part 2 shown in FIG. 3 were manufactured by the same method as the sample No. 2-2 except the following point.

As shown in FIG. 6, the angle (θ) at which the blank holder 33 and the second pad 34 were linearly moved along arrow C was set at 60°.

For the obtained curved channel part, a generated crack and a generated wrinkle were evaluated on the basis of Tables 2 and 3. As the result, with any of the materials of the used blank, the crack was O (no crack), and the wrinkle was ⊙ (no wrinkle at all by visual inspection).

<Sample No. 4-3>

The vertical wall portion 22 and the flange portion 24 continuous to the vertical wall portion 22 of the curved channel part 2 shown in FIG. 3 were manufactured by the same method as the sample No. 2-3 except the following point.

As shown in FIG. 6, the angle (θ) at which the blank holder 33 and the second pad 34 were linearly moved along arrow C was set at 60°.

For the obtained curved channel part, a generated crack and a generated wrinkle were evaluated on the basis of Tables 2 and 3. As the result, with any of the materials of the used blank, the crack was O (no crack), and the wrinkle was ⊙ (no wrinkle at all by visual inspection).

<Sample No. 4-4>

The vertical wall portion 22 and the flange portion 24 continuous to the vertical wall portion 22 of the curved channel part 2 shown in FIG. 3 were manufactured by the same method as the sample No. 2-4 except the following point.

As shown in FIG. 6, the angle (θ) at which the blank holder 33 and the second pad 34 were linearly moved along arrow C was set at 60°.

For the obtained curved channel part, a generated crack and a generated wrinkle were evaluated on the basis of Tables 2 and 3. As the result, with any of the materials of the used blank, the crack was O (no crack), and the wrinkle was ⊙ (no wrinkle at all by visual inspection).

<Sample No. 5-1>

The vertical wall portion 22 and the flange portion 24 continuous to the vertical wall portion 22 of the curved channel part 2 shown in FIG. 3 were manufactured by the same method as the sample No. 2-1 except the following point.

As shown in FIG. 6, the angle (θ) at which the blank holder 33 and the second pad 34 were linearly moved along arrow C was set at 20°.

For the obtained curved channel part, a generated crack and a generated wrinkle were evaluated on the basis of Tables 2 and 3. As the result, with any of the materials of the used blank, the crack was O (no crack), and the wrinkle was x (noticeable wrinkle).

<Sample No. 5-2>

The vertical wall portion 22 and the flange portion 24 continuous to the vertical wall portion 22 of the curved channel part 2 shown in FIG. 3 were manufactured by the same method as the sample No. 2-2 except the following point.

As shown in FIG. 6, the angle (θ) at which the blank holder 33 and the second pad 34 were linearly moved along arrow C was set at 20°.

For the obtained curved channel part, a generated crack and a generated wrinkle were evaluated on the basis of Tables 2 and 3. As the result, with any of the materials of the used blank, the crack was O (no crack), and the wrinkle was x (noticeable wrinkle).

<Sample No. 5-3>

The vertical wall portion 22 and the flange portion 24 continuous to the vertical wall portion 22 of the curved channel part 2 shown in FIG. 3 were manufactured by the same method as the sample No. 2-3 except the following point.

As shown in FIG. 6, the angle (θ) at which the blank holder 33 and the second pad 34 were linearly moved along arrow C was set at 20°.

For the obtained curved channel part, a generated crack and a generated wrinkle were evaluated on the basis of Tables 2 and 3. As the result, with any of the materials of the used blank, the crack was O (no crack), and the wrinkle was x (noticeable wrinkle).

<Sample No. 5-4>

The vertical wall portion 22 and the flange portion 24 continuous to the vertical wall portion 22 of the curved channel part 2 shown in FIG. 3 were manufactured by the same method as the sample No. 2-4 except the following point.

As shown in FIG. 6, the angle (θ) at which the blank holder 33 and the second pad 34 were linearly moved along arrow C was set at 20°.

For the obtained curved channel part, a generated crack and a generated wrinkle were evaluated on the basis of Tables 2 and 3. As the result, with any of the materials of the used blank, the crack was O (no crack), and the wrinkle was x (noticeable wrinkle).

<Sample No. 6-1>

The vertical wall portion 22 and the flange portion 24 continuous to the vertical wall portion 22 of the curved channel part 2 shown in FIG. 3 were manufactured by the same method as the sample No. 2-1 except the following point.

As shown in FIG. 6, the angle (θ) at which the blank holder 33 and the second pad 34 were linearly moved along arrow C was set at 70°.

For the obtained curved channel part, a generated crack and a generated wrinkle were evaluated on the basis of Tables 2 and 3. As the result, with any of the materials of the used blank, the crack was x (crack in vertical wall portion), and the wrinkle was x (noticeable wrinkle).

<Sample No. 6-2>

The vertical wall portion 22 and the flange portion 24 continuous to the vertical wall portion 22 of the curved channel part 2 shown in FIG. 3 were manufactured by the same method as the sample No. 2-2 except the following point.

As shown in FIG. 6, the angle (θ) at which the blank holder 33 and the second pad 34 were linearly moved along arrow C was set at 70°.

For the obtained curved channel part, a generated crack and a generated wrinkle were evaluated on the basis of Tables 2 and 3. As the result, with any of the materials of the used blank, the crack was x (crack in vertical wall portion), and the wrinkle was x (noticeable wrinkle).

<Sample No. 6-3>

The vertical wall portion 22 and the flange portion 24 continuous to the vertical wall portion 22 of the curved channel part 2 shown in FIG. 3 were manufactured by the same method as the sample No. 2-3 except the following point.

As shown in FIG. 6, the angle (θ) at which the blank holder 33 and the second pad 34 were linearly moved along arrow C was set at 70°.

For the obtained curved channel part, a generated crack and a generated wrinkle were evaluated on the basis of Tables 2 and 3. As the result, with any of the materials of the used blank, the crack was x (crack in vertical wall portion), and the wrinkle was x (noticeable wrinkle).

<Sample No. 6-4>

The vertical wall portion 22 and the flange portion 24 continuous to the vertical wall portion 22 of the curved channel part 2 shown in FIG. 3 were manufactured by the same method as the sample No. 2-4 except the following point.

As shown in FIG. 6, the angle (θ) at which the blank holder 33 and the second pad 34 were linearly moved along arrow C was set at 70°.

For the obtained curved channel part, a generated crack and a generated wrinkle were evaluated on the basis of Tables 2 and 3. As the result, with any of the materials of the used blank, the crack was x (crack in vertical wall portion), and the wrinkle was x (noticeable wrinkle).

<Sample No. 7-1>

The vertical wall portion 22 and the flange portion 24 continuous to the vertical wall portion 22 of the curved channel part 2 shown in FIG. 3 were formed in two steps of the deep drawing step and then the shear deformation step by the method of the fifth embodiment shown in FIG. 9.

The die used in the deep drawing step is provided by replacing the second pad 34 with the die 37 in the die shown in FIG. 13. The chamfering radius at a lower-end corner portion of the die 37 is 10 mm being the same as the chamfering radius R4 of a lower-end corner portion of the second pad 34 of the die shown in FIG. 13. A distance L (see FIG. 9A) between the punch 31 and the die 37 was set at 87 mm.

First, as shown in FIG. 9A, the boundary-side portion 11*a* of the base section 11 of the blank 1 was pinched and restrained by the punch 31 and the first pad 32, and the outer portion 12*d* of the deformation section 12 of the blank 1 was arranged between the blank holder 33 and the die 37. Then, the deep drawing step was executed, in which the blank holder 33 and the die 37 were moved in the B direction by 50 mm while a tensile force was applied to the outer portion 12*d*. The deep drawing step was executed until the angle β between the portion 12*a* to be the vertical wall portion and the side surface of the die 37 became 60°. Accordingly, the height T1 of the portion 12*a* to be the vertical wall portion was set at 50 mm.

Then, the die 37 was replaced with the second pad 34, the blank holder 33 and the second pad 34 were connected to the same moving mechanism as that used for the sample No. 2-1, and as shown in FIG. 9B, the outer portion 12*d* of the deformation section 12 of the blank 1 was restrained between the blank holder 33 and the second pad 34. The arrangement distance S0 between the punch 31 and the second pad 34 was set at 87 mm.

Then, the angle θ with respective to the sheet face of the portion 12*a* to be the vertical wall portion of the blank 1 was set at 60°, and the blank holder 33 and the second pad 34 were linearly moved along arrow C. The movement was executed until a distance S between the punch 31 and the second pad 34 became 10 mm. Accordingly, the portion 12*a* to be the vertical wall portion was shear-deformed and the vertical wall portion 22 was formed. A height T2 of the vertical wall portion 22 in FIG. 9B, was 100 mm.

In this example, the shear deformation step was executed at a room temperature by using a non-heated blank.

For the obtained curved channel part, a generated crack and a generated wrinkle were evaluated on the basis of Tables 2 and 3. As the result, with any of the materials of the used blank, the crack was O (no crack), and the wrinkle was O (very small wrinkle negligible in quality).

<Sample No. 7-2>

The vertical wall portion 22 and the flange portion 24 continuous to the vertical wall portion 22 of the curved channel part 2 shown in FIG. 3 were manufactured by the same method as the sample No. 7-1 except the following point.

In this example, from the state in FIG. 9B, the wrinkle stretching step was executed by further pinching the vertical wall portion 22 by the punch 31 and the second pad 34.

For the obtained curved channel part, a generated crack and a generated wrinkle were evaluated on the basis of Tables 2 and 3. As the result, with any of the materials of the used blank, the crack was O (no crack), and the wrinkle was ⊙ (no wrinkle at all by visual inspection).

<Sample No. 7-3>

The vertical wall portion 22 and the flange portion 24 continuous to the vertical wall portion 22 of the curved channel part 2 shown in FIG. 3 were manufactured by the same method as the sample No. 7-1 except the following point.

In this example, the shear deformation step was executed by using a blank heated at 300° C.

For the obtained curved channel part, a generated crack and a generated wrinkle were evaluated on the basis of Tables 2 and 3. As the result, with any of the materials of the used blank, the crack was O (no crack), and the wrinkle was ⊙ (no wrinkle at all by visual inspection).

<Sample No. 7-4>

The vertical wall portion 22 and the flange portion 24 continuous to the vertical wall portion 22 of the curved channel part 2 shown in FIG. 3 were manufactured by the same method as the sample No. 7-1 except the following point.

In this example, the shear deformation step was executed by using a blank heated at 300° C. Also, from the state in FIG. 9B, the wrinkle stretching step was executed by further pinching the vertical wall portion 22 by the punch 31 and the second pad 34.

For the obtained curved channel part, a generated crack and a generated wrinkle were evaluated on the basis of Tables 2 and 3. As the result, with any of the materials of the used blank, the crack was O (no crack), and the wrinkle was ⊙ (no wrinkle at all by visual inspection).

<Sample No. 8-1>

The vertical wall portion 22 and the flange portion 24 continuous to the vertical wall portion 22 of the curved channel part 2 shown in FIG. 3 were formed in two steps of the shear deformation step and then the deep drawing step by the method of the fourth embodiment shown in FIG. 8.

In the shear deformation step, the same die as that used for the sample No. 2-1 was used, and the arrangement distance S0 (see FIG. 8A) between the punch 31 and the second pad 34 was set at 50 mm.

As shown in FIG. 8A, first, the boundary-side portion 11*a* of the base section 11 of the blank 1 was pinched and restrained by the punch 31 and the first pad 32, and the outer portion (the portion to be the flange portion) 12*b* of the deformation section 12 was pinched and restrained by the blank holder 33 and the second pad 34. Then, the shear deformation step was executed by linearly moving the blank holder 33 and the second pad 34 along arrow C while θ=45°. The shear deformation step was executed at a room temperature by using a non-heated blank until a height T1 of the inner portion 12*c* of the blank 1 became 50 mm.

Then, as shown in FIG. 8B, the second pad 34 was replaced with the die 37, the die 37 and the blank holder 33 were connected to the moving mechanism for deep drawing, and the outer portion 12*b* of the blank 1 was arranged between the die 37 and the blank holder 33. Then, the deep drawing step was executed, in which the die 37 and the blank holder 33 were moved in the B direction by 50 mm while a tensile force was applied to the outer portion 12*b*. The deep drawing step was executed until the height T2 of the vertical wall portion 22 became 100 mm.

For the obtained curved channel part, a generated crack and a generated wrinkle were evaluated on the basis of Tables 2 and 3. As the result, with any of the materials of the used blank, the crack was O (no crack), and the wrinkle was O (very small wrinkle negligible in quality).

<Sample No. 8-2>

The vertical wall portion 22 and the flange portion 24 continuous to the vertical wall portion 22 of the curved channel part 2 shown in FIG. 3 were manufactured by the same method as the sample No. 8-1 except the following point.

In this example, from the state in FIG. 8B, the wrinkle stretching step was executed by further pinching the vertical wall portion 22 by the punch 31 and the die 37.

For the obtained curved channel part, a generated crack and a generated wrinkle were evaluated on the basis of Tables 2 and 3. As the result, with any of the materials of the used blank, the crack was O (no crack), and the wrinkle was ⊙ (no wrinkle at all by visual inspection).

<Sample No. 8-3>

The vertical wall portion 22 and the flange portion 24 continuous to the vertical wall portion 22 of the curved channel part 2 shown in FIG. 3 were manufactured by the same method as the sample No. 8-1 except the following point.

In this example, the shear deformation step was executed by using a blank heated at 300° C.

For the obtained curved channel part, a generated crack and a generated wrinkle were evaluated on the basis of Tables 2 and 3. As the result, with any of the materials of the used blank, the crack was O (no crack), and the wrinkle was ⊙ (no wrinkle at all by visual inspection).

<Sample No. 8-4>

The vertical wall portion 22 and the flange portion 24 continuous to the vertical wall portion 22 of the curved channel part 2 shown in FIG. 3 were manufactured by the same method as the sample No. 8-1 except the following point.

In this example, the shear deformation step was executed by using a blank heated at 300° C. Also, from the state in FIG. 8B, the wrinkle stretching step was executed by further pinching the vertical wall portion 22 by the punch 31 and the die 37.

For the obtained curved channel part, a generated crack and a generated wrinkle were evaluated on the basis of Tables 2 and 3. As the result, with any of the materials of the used blank, the crack was O (no crack), and the wrinkle was ⊙ (no wrinkle at all by visual inspection).

<Sample No. 9-1>

The vertical wall portion 22 and the flange portion 24 continuous to the vertical wall portion 22 of the curved channel part 2 shown in FIG. 3 were formed only in the deep drawing step.

Figure 15A:
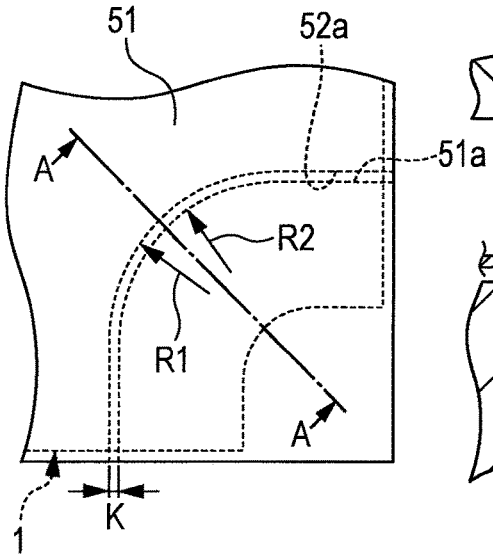
FIG. 15A and FIG. 15B provide a plan view (FIG. 15A) explaining a deep drawing step executed in an example, and an A-A cross-sectional view (FIG. 15B) thereof.
Figure 15B:
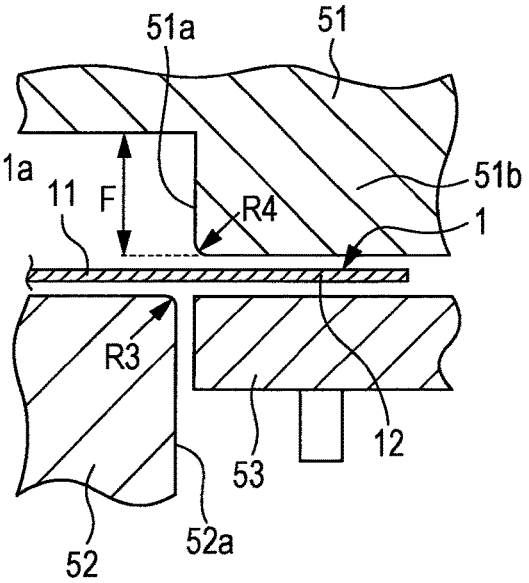

FIG. 15A is a plan view of the used die and blank. FIG. 15B is an A-A cross-sectional view thereof.

The die used for press forming is the same as the die for deep drawing of related art, and includes a die 51, a punch 52, and a pair of blank holders 53. A portion of an inner peripheral surface 51*a* of a depressed portion of the die 51, which corresponds to the curved portion 22*a*, has a curvature radius R1 of 100 mm. A depth F of the depressed portion of the die 51 is 100 mm. A portion of an outer peripheral surface 52*a* of the punch 52, which corresponds to the curved portion 22*a*, has a curvature radius R2 of 90 mm.

A distance K between the inner peripheral surface 51*a* of the die 51 and the outer peripheral surface 52*a* of the punch 52 was set at 10 mm. A chamfering radius R3 of an upper-end corner portion of the punch 52 was set at 10 mm, and a chamfering radius R4 of a lower-end corner portion of the inner peripheral surface 51*a* of the die 51 was set at 10 mm.

As shown in FIG. 15, first, the blank holders 53 were arranged at both sides of the punch 52, and the blank 1 was arranged on the punch 52 and the blank holders 53. The base section 11 of the blank 1 was arranged on the punch 52, and the deformation section 12 was arranged on the blank holders 53. Then, the die 51 was arranged above the blank 1, and the die 51 was lowered. At this time, a proper tensile force was applied to the deformation section 12 of the blank 1 held by a protruding portion 51*b* of the die 51 and the blank holders 53. The deep drawing step was executed at a room temperature.

Figure 16A:
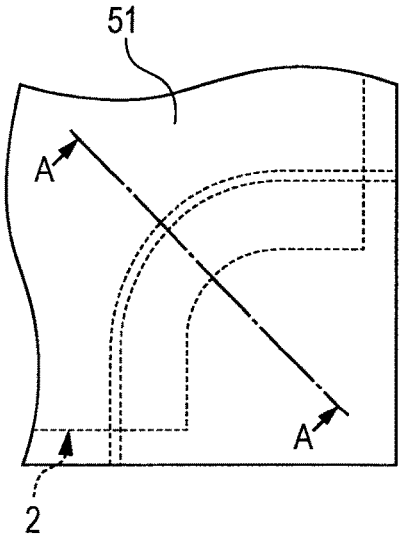
FIG. 16A and FIG. 16B provide a plan view (FIG. 16A) explaining a deep drawing step executed in an example, and an A-A cross-sectional view (FIG. 16B) thereof.
Figure 16B:
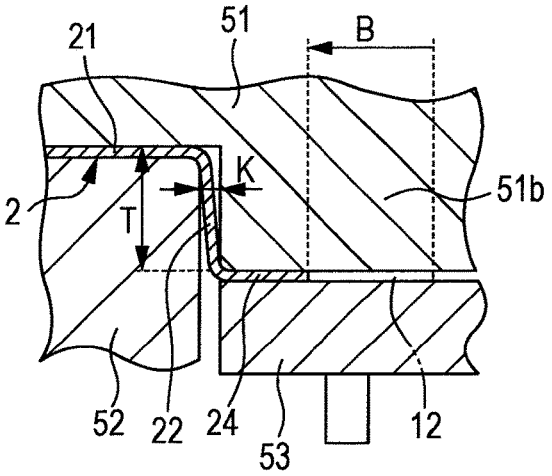

Accordingly, as shown in FIG. 16, the deformation section 12 of the blank 1 is moved toward the punch 52 between the protruding portion 51*b* of the die 51 and the blank holders 53 as indicated by arrow B while the deformation section 12 is bent by a depressed portion of the die 51 and the punch 52, and the material largely drawn into the area between the punch 52 and the die 51 forms the vertical wall portion 22. By executing the deep drawing step, the curved channel part 2 including the vertical wall portion 22 with a height T of 100 mm was obtained.

For the obtained curved channel part, a generated crack and a generated wrinkle were evaluated on the basis of Tables 2 and 3. As the result, if the material of the used blank was "270," the crack was Δ, and otherwise, the crack was x (F). If the material of the used blank was any of "270" and "aluminum alloy," the wrinkle was O (very small wrinkle negligible in quality), and otherwise, the wrinkle was x (noticeable wrinkle).

That is, in this example, if a 270 MPa grade steel sheet was used as the blank, the wrinkle evaluation had no problem; however, necking occurred at an end portion of the vertical wall portion. If any of 590, 980, 1180 MPa grade steel sheets with high strengths was used as the blank, a noticeable wrinkle was generated in the vertical wall portion, and a crack was generated in the flange portion. If an aluminum alloy sheet was used as the blank, the wrinkle evaluation had no problem; however, a crack was generated in the flange portion.

<Sample No. 9-2>

The vertical wall portion 22 and the flange portion 24 continuous to the vertical wall portion 22 of the curved channel part 2 shown in FIG. 3 were manufactured by the same method as the sample No. 9-1 except the following point.

In this example, the deep drawing step was executed by using a blank heated at 300° C.

For the obtained curved channel part, a generated crack and a generated wrinkle were evaluated on the basis of Tables 2 and 3. As the result, with any of the materials of the used blank, the crack was x (crack in vertical wall portion). If the material of the used blank was any of "980" and "1180," the wrinkle was x (noticeable wrinkle), and otherwise, the wrinkle was O (very small wrinkle negligible in quality).

<Sample No. 10-1>

The curved channel part 4 shown in FIG. 10 was formed by the two steps of the shear deformation step and then the stamping step by the method of the sixth embodiment shown in FIG. 11.

In the shear deformation step, the same die as that used for the sample No. 2-1 was used, and the arrangement distance S0 between the punch 31 and the second pad 34 was set at 50 mm.

As shown in FIG. 11A, first, the boundary-side portion 11*a* of the base section 11 of the blank 1 was pinched and restrained by the punch 31 and the first pad 32, and the outer portion (the portion to be the flange portion) 12*b* of the deformation section 12 was pinched and restrained by the blank holder 33 and the second pad 34. Then, the shear deformation step was executed by linearly moving the blank holder 33 and the second pad 34 restraining the outer portion 12*b* along arrow C while θ=45°.

In this state, the portion 12*a* to be the vertical wall portion becomes an inclined wall portion, and the outer portion 12*b* becomes a flange portion. The shear deformation step was executed at a room temperature by using a non-heated blank until a height T1 of the inclined wall portion became 25 mm.

Then, as shown in FIG. 11B, the blank holder 33 and the second pad 34 restraining the outer portion 12*b* were released, and the die 37 was arranged on the portion (the inclined wall portion) 12*a* to be the vertical wall portion of the blank 1 and the outer portion (the flange portion) 12*b*. Then, the stamping step was executed by moving the die 37 along arrow B. Accordingly, the bent portion between the portion 12*b* transiently being the flange portion and the inclined wall portion 12*a* were stretched and the vertical wall portion 42 was formed. A height T2 of the vertical wall portion 42 in FIG. 11B was 100 mm.

For the obtained curved channel part, a generated crack and a generated wrinkle were evaluated on the basis of Tables 2 and 3. As the result, with any of the materials of the used blank, the crack was O (no crack), and the wrinkle was O (very small wrinkle negligible in quality).

<Sample No. 10-2>

The curved channel part 4 shown in FIG. 10 was manufactured by the same method as the sample No. 10-1 except the following point.

In this example, from the state in FIG. 11B, the wrinkle stretching step was executed by further pinching the vertical wall portion 42 by the punch 31 and the die 37.

For the obtained curved channel part, a generated crack and a generated wrinkle were evaluated on the basis of Tables 2 and 3. As the result, with any of the materials of the used blank, the crack was O (no crack), and the wrinkle was ⊙ (no wrinkle at all by visual inspection).

<Sample No. 10-3>

The curved channel part 4 shown in FIG. 10 was manufactured by the same method as the sample No. 10-1 except the following point.

In this example, the shear deformation step was executed by using a blank heated at 300° C.

For the obtained curved channel part, a generated crack and a generated wrinkle were evaluated on the basis of Tables 2 and 3. As the result, with any of the materials of the used blank, the crack was O (no crack), and the wrinkle was ⊙ (no wrinkle at all by visual inspection).

<Sample No. 10-4>

The curved channel part 4 shown in FIG. 10 was manufactured by the same method as the sample No. 10-1 except the following point.

In this example, the shear deformation step was executed by using a blank heated at 300° C. Also, from the state in FIG. 11B, the wrinkle stretching step was executed by further pinching the vertical wall portion 42 by the punch 31 and the die 37.

For the obtained curved channel part, a generated crack and a generated wrinkle were evaluated on the basis of Tables 2 and 3. As the result, with any of the materials of the used blank, the crack was O (no crack), and the wrinkle was ⊙ (no wrinkle at all by visual inspection).

<Sample No. 11-1>

The curved channel part 4 shown in FIG. 10 was manufactured only by stamping.

A die obtained by removing the blank holders 53 from the die shown in FIG. 15 used for the sample No. 9-1 was used, the base section 11 of the blank 1 was arranged on the punch 52, then the die 51 was arranged above the blank 1, the die 51 was lowered, and hence the deformation section 12 of the blank 1 was bent. Thus, the vertical wall portion 42 was formed.

For the obtained curved channel part, a generated crack and a generated wrinkle were evaluated on the basis of Tables 2 and 3. As the result, if the material of the used blank was "270," the crack was Δ, and otherwise, the crack was x (K). If the material of the used blank was any of "270" and "aluminum alloy," the wrinkle was O (very small wrinkle negligible in quality), and otherwise, the wrinkle was x (noticeable wrinkle).

That is, in this example, if a 270 MPa grade steel sheet was used as the blank, the wrinkle evaluation had no problem; however, necking occurred at an end portion of the vertical wall portion. If any of 590, 980, and 1180 MPa grade steel sheets with high strengths was used as the blank, a crack was generated in an end portion of the vertical wall portion, and hence a wrinkle was generated in the vertical wall portion. If an aluminum alloy sheet was used as the blank, the wrinkle evaluation had no problem; however, a crack was generated in an end portion of the vertical wall portion.

<Sample No. 11-2>

The curved channel part 4 shown in FIG. 10 was manufactured by the same method as the sample No. 11-1 except the following point.

In this example, the stamping step was executed by using a blank heated at 300° C.

For the obtained curved channel part, a generated crack and a generated wrinkle were evaluated on the basis of Tables 2 and 3. As the result, with any of the materials of the used blank, the crack was x (crack in vertical wall portion). If the material of the used blank was "1180," the wrinkle was x (noticeable wrinkle), and otherwise, the wrinkle was O (very small wrinkle negligible in quality).

<Sample No. 12-1>

The vertical wall portion 22 and the flange portion 24 continuous to the vertical wall portion 22 of the curved channel part 2 shown in FIG. 3 were manufactured by the same method as the sample No. 2-1 except the following point. As shown in FIG. 7, the angle (θ) at which the blank holder 33 and the second pad 36 were linearly moved along arrow C was set at 45°.

For the obtained curved channel part, a generated crack and a generated wrinkle were evaluated on the basis of Tables 2 and 3. As the result, in the case of the sample No. 10-1, with any of the materials of the used blank, the crack was O (no crack), and the wrinkle was ⊙ (no wrinkle at all by visual inspection).

<Sample No. 12-2>

The vertical wall portion 22 and the flange portion 24 continuous to the vertical wall portion 22 of the curved channel part 2 shown in FIG. 3 were manufactured by the same method as the sample No. 2-2 except the following point. As shown in FIG. 7, the angle (θ) at which the blank holder 33 and the second pad 36 were linearly moved along arrow C was set at 45°.

For the obtained curved channel part, a generated crack and a generated wrinkle were evaluated on the basis of Tables 2 and 3. As the result, with any of the materials of the used blank, the crack was O (no crack), and the wrinkle was ⊙ (no wrinkle at all by visual inspection).

<Sample No. 12-3>

The vertical wall portion 22 and the flange portion 24 continuous to the vertical wall portion 22 of the curved channel part 2 shown in FIG. 3 were manufactured by the same method as the sample No. 2-3 except the following point. As shown in FIG. 7, the angle (θ) at which the blank holder 33 and the second pad 36 were linearly moved along arrow C was set at 45°.

For the obtained curved channel part, a generated crack and a generated wrinkle were evaluated on the basis of Tables 2 and 3. As the result, with any of the materials of the used blank, the crack was O (no crack), and the wrinkle was ⊙ (no wrinkle at all by visual inspection).

<Sample No. 12-4>

The vertical wall portion 22 and the flange portion 24 continuous to the vertical wall portion 22 of the curved channel part 2 shown in FIG. 3 were manufactured by the same method as the sample No. 2-4 except the following point. As shown in FIG. 7, the angle (θ) at which the blank holder 33 and the second pad 36 were linearly moved along arrow C was set at 45°.

For the obtained curved channel part, a generated crack and a generated wrinkle were evaluated on the basis of Tables 2 and 3. As the result, with any of the materials of the used blank, the crack was O (no crack), and the wrinkle was ⊙ (no wrinkle at all by visual inspection).

<Sample No. 13-1>

The vertical wall portion 42 of the curved channel part shown in FIG. 10 was formed by two steps of the shear deformation step and then the stamping step by the method of the sixth embodiment shown in FIG. 11.

In the shear deformation step, the same die as that used for the sample No. 2-1 was used, and the arrangement distance S0 (see FIG. 11A) between the punch 31 and the second pad 34 was set at 50 mm. As shown in FIG. 11A, first, the boundary-side portion 11*a* of the base section 11 of the blank 1 was pinched and restrained by the punch 31 and the first pad 32, and the outer portion (the portion to be the flange portion) 12*b* of the deformation section 12 was pinched and restrained by the blank holder 33 and the second pad 34. Then, the shear deformation step was executed by linearly moving the blank holder 33 and the second pad 34 along arrow C while θ=45°. The shear deformation step was executed at a room temperature by using a non-heated blank until the height T1 of the inner portion 12*c* of the blank 1 became 50 mm.

Then, as shown in FIG. 11B, the second pad 34 and the blank holder 33 restraining the outer portion 12*b* were released, and the die 37 was arranged on the portion 12*a* to be the vertical wall portion and the outer portion 12*b*. Then, the stamping step for forming the vertical wall portion 42 was executed by moving the die 37 along arrow B and hence stretching the bent portion. The stamping step was executed until the height T2 of the vertical wall portion 22 became 100 mm.

For the obtained curved channel part, a generated crack and a generated wrinkle were evaluated on the basis of Tables 2 and 3. As the result, with any of the materials of the used blank, the crack was O (no crack), and the wrinkle was O (very small wrinkle negligible in quality).

<Sample No. 13-2>

The vertical wall portion 42 of the curved channel part shown in FIG. 10 was manufactured by the same method as the sample No. 11-1 except the following point. In this example, from the state in FIG. 11B, the wrinkle stretching step was executed by further pinching the vertical wall portion 42 by the punch 31 and the die 37.

For the obtained curved channel part, a generated crack and a generated wrinkle were evaluated on the basis of Tables 2 and 3. As the result, with any of the materials of the used blank, the crack was O (no crack), and the wrinkle was ⊙ (no wrinkle at all by visual inspection).

<Sample No. 13-3>

The vertical wall portion 42 of the curved channel part shown in FIG. 10 was manufactured by the same method as the sample No. 11-1 except the following point. In this example, the shear deformation step was executed by using a blank heated at 300° C.

For the obtained curved channel part, a generated crack and a generated wrinkle were evaluated on the basis of Tables 2 and 3. As the result, with any of the materials of the used blank, the crack was O (no crack), and the wrinkle was ⊙ (no wrinkle at all by visual inspection).

<Sample No. 13-4>

The vertical wall portion 42 of the curved channel part shown in FIG. 10 was manufactured by the same method as the sample No. 11-1 except the following point. In this example, the shear deformation step was executed by using a blank heated at 300° C. Also, from the state in FIG. 11B, the wrinkle stretching step was executed by further pinching the vertical wall portion 42 by the punch 31 and the die 37.

For the obtained curved channel part, a generated crack and a generated wrinkle were evaluated on the basis of Tables 2 and 3. As the result, with any of the materials of the used blank, the crack was O (no crack), and the wrinkle was ⊙ (no wrinkle at all by visual inspection).

These results are shown in Tables 4 to 6 as follows. Table 4 collectively shows the results of No. 1-1 to No. 9-2 in which the curved channel parts with the flange portions were manufactured. Table 5 collectively shows the results of No. 10-1 to No. 11-2 in which the curved channel parts without a flange portion were manufactured. Table 6 collectively shows the results of No. 12-1 to No. 13-4.

TABLE 4

| | Forming method | | | Evaluation | | | | | | | | | |
|---|---|---|---|---|---|---|---|---|---|---|---|---|---|
| | | | | Crack | | | | | Wrinkle | | | | |
| No. | Forming step of vertical wall portion | Blank heating | Wrinkle stretching step | 270 | 590 | 980 | 1180 | Al | 270 | 590 | 980 | 1180 | Al |
| 1-1 | Only shear deformation | Absent | Absent | ○ | ○ | ○ | ○ | ○ | ○ | ○ | ○ | ○ | ○ |
| 1-2 | step (rotation) | Absent | Present | ○ | ○ | ○ | ○ | ○ | ⊙ | ⊙ | ⊙ | ⊙ | ⊙ |
| 1-3 | | Present | Absent | ○ | ○ | ○ | ○ | ○ | ⊙ | ⊙ | ⊙ | ⊙ | ⊙ |
| 1-4 | | Present | Present | ○ | ○ | ○ | ○ | ○ | ⊙ | ⊙ | ⊙ | ⊙ | ⊙ |
| 2-1 | Only shear deformation | Absent | Absent | ○ | ○ | ○ | ○ | ○ | ○ | ○ | ○ | ○ | ○ |
| 2-2 | step (linear movement | Absent | Present | ○ | ○ | ○ | ○ | ○ | ⊙ | ⊙ | ⊙ | ⊙ | ⊙ |
| 2-3 | θ = 30°) | Present | Absent | ○ | ○ | ○ | ○ | ○ | ⊙ | ⊙ | ⊙ | ⊙ | ⊙ |
| 2-4 | | Present | Present | ○ | ○ | ○ | ○ | ○ | ⊙ | ⊙ | ⊙ | ⊙ | ⊙ |
| 3-1 | Only shear deformation | Absent | Absent | ○ | ○ | ○ | ○ | ○ | ○ | ○ | ○ | ○ | ○ |
| 3-2 | step (linear movement | Absent | Present | ○ | ○ | ○ | ○ | ○ | ⊙ | ⊙ | ⊙ | ⊙ | ⊙ |
| 3-3 | θ = 45°) | Present | Absent | ○ | ○ | ○ | ○ | ○ | ⊙ | ⊙ | ⊙ | ⊙ | ⊙ |
| 3-4 | | Present | Present | ○ | ○ | ○ | ○ | ○ | ⊙ | ⊙ | ⊙ | ⊙ | ⊙ |
| 4-1 | Only shear deformation | Absent | Absent | ○ | ○ | ○ | ○ | ○ | ○ | ○ | ○ | ○ | ○ |
| 4-2 | step (linear movement | Absent | Present | ○ | ○ | ○ | ○ | ○ | ⊙ | ⊙ | ⊙ | ⊙ | ⊙ |
| 4-3 | θ = 60°) | Present | Absent | ○ | ○ | ○ | ○ | ○ | ⊙ | ⊙ | ⊙ | ⊙ | ⊙ |
| 4-4 | | Present | Present | ○ | ○ | ○ | ○ | ○ | ⊙ | ⊙ | ⊙ | ⊙ | ⊙ |
| 5-1 | Only shear deformation | Absent | Absent | ○ | ○ | ○ | ○ | ○ | X | X | X | X | X |
| 5-2 | step (linear movement | Absent | Present | ○ | ○ | ○ | ○ | ○ | X | X | X | X | X |
| 5-3 | θ = 20°) | Present | Absent | ○ | ○ | ○ | ○ | ○ | X | X | X | X | X |
| 5-4 | | Present | Present | ○ | ○ | ○ | ○ | ○ | X | X | X | X | X |
| 6-1 | Only shear deformation | Absent | Absent | X (K) | X (K) | X (K) | X (K) | X (K) | X | X | X | X | X |
| 6-2 | step (linear movement | Absent | Present | X (K) | X (K) | X (K) | X (K) | X (K) | X | X | X | X | X |
| 6-3 | θ = 70°) | Present | Absent | X (K) | X (K) | X (K) | X (K) | X (K) | X | X | X | X | X |
| 6-4 | | Present | Present | X (K) | X (K) | X (K) | X (K) | X (K) | X | X | X | X | X |
| 7-1 | Deep drawing step and | Absent | Absent | ○ | ○ | ○ | ○ | ○ | ○ | ○ | ○ | ○ | ○ |
| 7-2 | then shear deformation | Absent | Present | ○ | ○ | ○ | ○ | ○ | ⊙ | ⊙ | ⊙ | ⊙ | ⊙ |
| 7-3 | step (linear movement | Present | Absent | ○ | ○ | ○ | ○ | ○ | ⊙ | ⊙ | ⊙ | ⊙ | ⊙ |
| 7-4 | θ = 60°) | Present | Present | ○ | ○ | ○ | ○ | ○ | ⊙ | ⊙ | ⊙ | ⊙ | ⊙ |
| 8-1 | Shear deformation step | Absent | Absent | ○ | ○ | ○ | ○ | ○ | ○ | ○ | ○ | ○ | ○ |
| 8-2 | (linear movement θ = | Absent | Present | ○ | ○ | ○ | ○ | ○ | ⊙ | ⊙ | ⊙ | ⊙ | ⊙ |
| 8-3 | 45°) and then deep | Present | Absent | ○ | ○ | ○ | ○ | ○ | ⊙ | ⊙ | ⊙ | ⊙ | ⊙ |
| 8-4 | drawing step | Present | Present | ○ | ○ | ○ | ○ | ○ | ⊙ | ⊙ | ⊙ | ⊙ | ⊙ |
| 9-1 | Only deep drawing step | Absent | Absent | Δ | X (F) | X (F) | X (F) | X (F) | ○ | X | X | X | ○ |
| 9-2 | | Present | Absent | X (K) | X (K) | X (K) | X (K) | X (K) | ○ | ○ | X | X | ○ |

TABLE 5

| | Forming method | | | Evaluation | | | | | | | | | |
|---|---|---|---|---|---|---|---|---|---|---|---|---|---|
| | | | | Crack | | | | | Wrinkle | | | | |
| No. | Forming step of vertical wall portion | Blank heating | Wrinkle stretching step | 270 | 590 | 980 | 1180 | Al | 270 | 590 | 980 | 1180 | Al |
| 10-1 | Shear deformation | Absent | Absent | ○ | ○ | ○ | ○ | ○ | ○ | ○ | ○ | ○ | ○ |
| 10-2 | step (linear | Absent | Present | ○ | ○ | ○ | ○ | ○ | ⊙ | ⊙ | ⊙ | ⊙ | ⊙ |
| 10-3 | movement θ = 45°) | Present | Absent | ○ | ○ | ○ | ○ | ○ | ⊙ | ⊙ | ⊙ | ⊙ | ⊙ |
| 10-4 | and then stamping step | Present | Present | ○ | ○ | ○ | ○ | ○ | ⊙ | ⊙ | ⊙ | ⊙ | ⊙ |
| 11-1 | Only stamping step | Absent | Absent | Δ | X (K) | X (K) | X (K) | X (K) | ○ | X | X | X | ○ |
| 11-2 | | Present | Absent | X (K) | X (K) | X (K) | X (K) | X (K) | ○ | ○ | ○ | X | ○ |

TABLE 6

| | Forming method | | | Evaluation | | | | | | | | | |
|---|---|---|---|---|---|---|---|---|---|---|---|---|---|
| | | | | Crack | | | | | Wrinkle | | | | |
| No. | Forming step of vertical wall portion | Blank heating | Wrinkle stretching step | 270 | 590 | 980 | 1180 | Al | 270 | 590 | 980 | 1180 | Al |
| 12-1 | Only shear deformation | Absent | Absent | Entirely ○ | | | | | Entirely ⊙ | | | | |
| 12-2 | step (linear movement θ = | Absent | Present | | | | | | | | | | |
| 12-3 | 45°) | Present | Absent | | | | | | | | | | |
| 12-4 | | Present | Present | | | | | | | | | | |

TABLE 6-continued

| | Forming method | | | Evaluation | | | | | | | | | |
|---|---|---|---|---|---|---|---|---|---|---|---|---|---|
| | | | Wrinkle | Crack | | | | | Wrinkle | | | | |
| No. | Forming step of vertical wall portion | Blank heating | stretching step | 270 | 590 | 980 | 1180 | Al | 270 | 590 | 980 | 1180 | Al |
| 13-1 | Shear deformation step | Absent | Absent | Same as EXAMPLES 8-1 to 8-4 | | | | | Same as EXAMPLES 8-1 to 8-4 | | | | |
| 13-2 | (linear movement θ = | Absent | Present | | | | | | | | | | |
| 13-3 | 45°) and then | Present | Absent | | | | | | | | | | |
| 13-4 | stamping step | Present | Present | | | | | | | | | | |

Referring to these results, the following findings are obtained.

The samples No. 1-1 to No. 4-4 each employ the method of the above-described configuration (3) or (4) as the step of forming the vertical wall portion. Accordingly, if the vertical wall portion is formed only in the shear deformation step, by employing the method of the above-described configuration (3) or (4), the curved channel part with good evaluation results for crack and wrinkle can be obtained with any of all the materials.

The samples No. 5-1 to No. 6-4 each employ, as the step of forming the vertical wall portion, the method of linearly moving the restrained outer portion in the direction at the angle (θ) being 20° or 70° (outside the range from 30° to 60°) with respect to the sheet face of the blank.

Accordingly, the wrinkle generated in the vertical wall portion in the shear deformation step could not be removed although the blank heating and/or the wrinkle stretching step was executed (No. 5-2 to 5-4, No. 6-2 to 6-4). Also, in the samples No. 6-1 to No. 6-4 with θ=70°, a crack was generated in the vertical wall portion in the shear deformation step.

However, even in these cases, instead of forming the vertical wall portion only by a shear deformation force, if the vertical wall portion is formed by causing the material to flow while a proper tensile force is applied to the portion to be the vertical wall, the curved channel part in which stretch flange deformation is restricted, hence a crack is not generated, and a wrinkle is improved can be obtained.

In each of the above-described examples, the blank was heated at 300° C. For each of <Samples No. 1-3, 1-4, 2-3, 2-4, 3-3, 3-4, 4-3, 4-4, 7-3, 7-4, 8-3, 8-4, 10-3, 10-4, 13-3, 13-4>, heating was executed with heating temperatures of 600° C., 700° C., 900° C., and 1000° C. The results similar to the above description were obtained.

The curved channel part obtained by heating the blank at 1100° C. and then executing the shear deformation step had better crack and wrinkle evaluation results than the method of related art; however, a thick oxide layer of iron called scale was formed on the surface of the formed part. The thick scale disturbs welding and electro-deposition coating, and hence a removing step of pickling, polishing, or shot blast is required. Therefore the thick scale is not desirable in view of manufacturing cost.

REFERENCE SIGNS LIST

1 blank
11 base section of blank
11*b* center portion of base section
11*a* boundary-side portion of base section
12 deformation section of blank
12*a* portion to be vertical wall portion of deformation section
12*b* outer portion of deformation section
2 curved channel part
21 top portion
22 vertical wall portion
22*a* curved portion of vertical wall portion
24 flange portion
24*a* curved portion of flange portion
4 curved channel part
41 top portion
42 vertical wall portion
42*a* curved portion of vertical wall portion

The invention claimed is:

1. A press forming method for press-forming a flat-sheet-shaped processing material, the processing material including (i) a base section, (ii) a deformation section continuous with the base section, the deformation section including a portion configured to form a vertical wall portion and (iii) a boundary portion between the base section and the portion configured to form the vertical wall portion, the vertical wall portion having a curved portion that is curved in a depressed shape toward the base section, the method comprising:

individually restraining a boundary-side portion of the base section with respect to the deformation section and an outer portion of the deformation section, the outer portion forming a flange portion; and shear-deforming the portion configured to form the vertical wall portion to form the vertical wall portion by bending the processing material in at least the boundary portion, wherein the shear-deforming the portion configured to form the vertical wall portion causes a material to flow from a portion separated from the curved portion toward the curved portion of the portion configured to form the vertical wall portion.

2. The press forming method according to claim 1, wherein individually restraining the boundary-side portion of the base section uses a first restraining section of a die that restrains the boundary-side portion, and shear-deforming the portion configured to form the vertical wall portion includes, when viewed in a thickness direction of the processing material, from a state in which a second restraining section of the die that restrains the outer portion of the deformation section is separated from the first restraining section, relatively moving the second restraining section in a direction in which a separation distance between the first restraining section and the second restraining section decreases as the boundary portion is bent.

3. The press forming method according to claim 2, wherein shear-deforming the portion configured to form the vertical wall portion further includes moving the restrained outer portion so that the portion configured to form the vertical wall portion is rotated around a bending point of the curved portion on a boundary line of the boundary portion between the base section and the deformation section.

4. The press forming method according to claim 2, wherein shear-deforming the portion configured to form the vertical wall portion further includes linearly moving the restrained outer portion in a direction in which an angle with respect to a sheet face of the processing material is in the range of 30° to 60°.

5. The press forming method according to claim 1, further comprising deep drawing the processing material after shear-deforming the portion configured to form the vertical wall portion.

6. The press forming method according to claim 1, further comprising deep drawing the processing material before shear-deforming the portion configured to form the vertical wall portion.

7. The press forming method according to claim 1, further comprising stamping the processing material after shear-deforming the portion configured to form the vertical wall portion.

8. The press forming method according to claim 1, wherein shear-deforming the portion configured to form the vertical wall portion includes generating a wrinkle in the vertical wall portion, and the method further comprises stretching the wrinkle by pinching the vertical wall portion with a die after shear-deforming the portion configured to form the vertical wall portion.

9. The press forming method according to claim 8, wherein the die includes a press surface configured to contact a surface of the vertical wall portion, the press surface including a depression and a protrusion configured to increase a line length of the vertical wall portion.

10. The press forming method according to claim 1, wherein the processing material is a blank, and shear-deforming the portion configured to form the vertical wall portion includes heating the blank at a temperature in a range of 300° C. to 1000° C.

11. A method of manufacturing a press-formed part formed by press-forming a flat-sheet-shaped processing material into the press-formed part, the processing material including (i) a base section, (ii) a deformation section continuous with the base section, the deformation section including a portion configured to form a vertical wall portion in the press-formed part and (iii) a boundary portion between the base section and the portion configured to form the vertical wall portion, the vertical wall portion having a curved portion that is curved in a depressed shape toward the base section, the method comprising:

individually restraining a boundary-side portion of the base section with respect to the deformation section and an outer portion of the deformation section; and shear-deforming the portion configured to form the vertical wall portion to form the vertical wall portion by bending the processing material in at least the boundary portion, wherein the outer portion forms a flange portion in the press-formed part, and the shear-deforming the portion configured to form the vertical wall portion causes a material to flow from a portion separated from the curved portion toward the curved portion of the portion configured to form the vertical wall portion.

12. The press forming method according to claim 11, wherein individually restraining the boundary-side portion of the base section uses a first restraining section of a die that restrains the boundary-side portion, and shear-deforming the portion configured to form the vertical wall portion includes, when viewed in a thickness direction of the processing material, from a state in which a second restraining section of the die that restrains the outer portion of the deformation section is separated from the first restraining section, relatively moving the second restraining section in a direction in which a separation distance between the first restraining section and the second restraining section decreases as the boundary portion is bent.

13. The press forming method according to claim 12, wherein shear-deforming the portion configured to form the vertical wall portion further includes moving the restrained outer portion so that the portion configured to form the vertical wall portion is rotated around a bending point of the curved portion on a boundary line of the boundary portion between the base section and the deformation section.

14. The press forming method according to claim 12, wherein shear-deforming the portion configured to form the vertical wall portion further includes linearly moving the restrained outer portion in a direction in which an angle with respect to a sheet face of the processing material is in the range of 30° to 60°.

15. The press forming method according to claim 11, further comprising deep drawing the processing material after shear-deforming the portion configured to form the vertical wall portion.

16. The press forming method according to claim 11, further comprising deep drawing the processing material before shear-deforming the portion configured to form the vertical wall portion.

17. The press forming method according to claim 11, further comprising removing the flange portion from the press-formed part; and stamping the processing material after shear-deforming the portion configured to form the vertical wall portion.

18. The press forming method according to claim 11, wherein shear-deforming the portion configured to form the vertical wall portion includes generating a wrinkle in the vertical wall portion, and the method further comprises stretching the wrinkle by pinching the vertical wall portion with a die after shear-deforming the portion configured to form the vertical wall portion.

19. The press forming method according to claim 18, wherein the die includes a press surface configured to contact a surface of the vertical wall portion, the press surface including a depression and a protrusion configured to increase a line length of the vertical wall portion.

20. The press forming method according to claim 11, wherein the processing material is a blank, and shear-deforming the portion configured to form the vertical wall portion includes heating the blank at a temperature in a range of 300° C. to 1000° C.

* * * * *